US006264591B1

(12) United States Patent
Keen et al.

(10) Patent No.: US 6,264,591 B1
(45) Date of Patent: Jul. 24, 2001

(54) PLUG COMBINER INSPECTION SYSTEM AND METHOD

(75) Inventors: Bruce W. Keen, Chattanooga, TN (US); Janet L. Thompson, Chesterfield, VA (US); Marc Belcastro, Glen Allen, VA (US); Andrew Struckhoff, Alexandria, VA (US); Lee Cramer, Springfield, VA (US); Gilbert D. Glass, Alexandria, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/361,358

(22) Filed: Jul. 27, 1999

(51) Int. Cl.[7] ..... B31C 13/00

(52) U.S. Cl. ..... 493/4; 493/22; 250/559.04; 250/559.39

(58) Field of Search ..... 493/4, 37, 22; 250/224, 559.39, 559.12, 559.04

(56) References Cited

U.S. PATENT DOCUMENTS 3,355,592 * 11/1967 Muir .
4,238,994 12/1980 Koch ..... 493/4
4,644,150 * 2/1987 Kuga et al. .
4,724,429 * 2/1988 Millen et al. .
5,284,164 * 2/1994 Andrews et al. .
5,301,011 * 4/1994 Hoppe et al. .
5,311,291 * 5/1994 Cholet .
5,414,270 * 5/1995 Henderson et al. .
5,466,209 * 11/1995 Takegawa et al. .
6,075,882 * 6/2000 Mullins et al. .
6,097,482 * 8/2000 Smith et al. .

* cited by examiner

*Primary Examiner*—Eugene Kim
(74) *Attorney, Agent, or Firm*—Burns, Doane, Swecker & Mathis, LLP

(57) ABSTRACT

A cigarette filter rod system comprises a plug combiner machine having a knife located downstream from a sensor. The knife generates a trigger signal which prompts an Inspection Unit to locate a previously stored frame of sensor data corresponding the rod which was cut by the knife. The Inspection Unit applies thresholds to the frame of sensor data to determine the location of filter segment boundaries, and then determines whether air rings are present in the data. The Inspection Unit then compares measurements made on the frame of sensor data with a pre-stored recipe indicating expected values for the frame. Statistical data is sent to a Human-Machine Interface Unit for analysis and display. The system performs filter rod rejection and cut registration based on the analysis performed by the Inspection Unit and the Human-Machine Interface.

36 Claims, 18 Drawing Sheets

PLUG COMBINER INSPECTION SYSTEM AND METHOD

BACKGROUND

The present invention pertains to a system and method for monitoring the characteristics of rods comprising multiple segments. More particularly, the present invention relates to a system and method for monitoring the characteristics of cigarette filter rods having multiple segments and for ensuring that the rods are cut at desired locations along their lengths.

A typical cigarette comprises a wrapped tobacco column that optionally is tipped with a filter rod. The filter rod, in turn, may comprise plural segments. For instance, the filter rod may include a cellulose acetate (CA) segment adjacent to a cellulose acetate (CA) charcoal impregnated segment. Other known filter rods include an "air gap" disposed in the filter rod. As the name suggests, an air gap is a column of air disposed between filter segments.

The filter rods may be produced separately from the tobacco column, and later joined to the tobacco column in a tipping machine. More specifically, it is known to produce composite filter rods containing multiple filter rods, each filter rod constituting a separate filter rod which is subsequently combined with a tobacco column. For instance, FIG. 1 shows a composite rod made of alternating segments of cellulose acetate (i.e., segments 102, 106) and segments containing charcoal (i.e., segments 100, 104, 108). A total of four filter rods can be produced by cutting this composite rod into four equal length filter rods. Another known type of composite rod is shown in FIG. 2. This composite filter rod includes cellulose acetate segments (202, 206, 210, 214) and charcoal segments (200, 208 and 216). This composite filter rod also includes air gaps (204, 212) interposed between cellulose acetate segments (i.e., between segments 202 and 206, and between segments 210 and 214, respectively). This composite filter rod also produces four individual filter rods.

In the following discussion, the term "filter rod" is used to designate either a composite rod having multiple individual filter rods or to designate individual filter rods (depending on the context in which this term is used). The term "segment" is used to denote sections which are disposed within (or which will be disposed within) a filter rod. A segment of cellulose acetate (CA) which is impregnated with carbon is referred to alternatively as a "charcoal segment" for brevity.

FIG. 3 shows a machine 300 capable of producing the type of filter rod configuration shown in FIG. 2, which is described in U.S. Pat. No. 4,238,994 to Koch (which is incorporated herein in its entirety by reference). The machine 300 comprises two magazines or hoppers 302 and 304. Magazine 302 can hold rods made of acetate material and magazine 304 can hold charcoal impregnated CA rods. Rods from these two hoppers are transported by a series of conveyers 306 in a known manner to a combining conveyer 308. Before reaching conveyer 308, the rods may be cut into segments by rotary disk-shaped knives. At the combining conveyer 308, the segments are arranged into groups (e.g., group 310) comprising, for instance, the grouping pattern shown in FIG. 2. The spacing between adjacent groups forms the gaps in the filter rod.

Combining conveyer 308 transfers the groups of segments to the upper side of a running web 312. The web 312 contains an adhesive applied to its upper side by paster 314. The adhesive ensures that the segments in the groups maintain their axial relationship with respect to each other as they advance along the web 312 from the combining conveyer 308. The draping mechanism 316 next drapes the web 312 around the groups so that the web 312 is converted into a tubular envelope or wrapper. A seam on the web 312 is heated or cohered by a sealer 318. Thereafter, the web 312 is severed at regular intervals by a cutting mechanism 320 to yield filter rods of multiple unit length. The filter rods can then be transported to a filter tipping machine (not shown) via belt conveyor 324.

The length of the segments and the spacing between the segments should satisfy predetermined criteria. To this end, the machine 300 employs an optical detector 326. The optical detector 326 is positioned "upstream" from the cutting mechanism 320. The detector 326 transmits a beam of light through the advancing filter rod and detects the light after it passes through the rod. Light more readily passes through the gap segments than the cellulose acetate segments and the charcoal segments. Further, light more readily passes through the cellulose acetate segments than the charcoal segments. Hence, the output of the detector 326 can be used to determine the transition from one segment to another by noting changes in the output of the detector 326.

The machine 300 also employs an electrical encoder (not shown) associated with the cutting mechanism 320. The encoder outputs a pulse when the cutting mechanism severs a rod, and also outputs a series of pulses between each cut. The frequency of the pulses output by the encoder reflects the operating speed of the cutting mechanism 320 and also the speed at which the rods are advanced through the cutting mechanism 320. This encoder information is fed to circuit 327, along with the output of the detector 326. Together, the output of the detector 326 and the output of the encoder allow the circuit 327 to calculate the length of segments within the filter rod and also to determine whether the rods are being cut at desired locations. This information can also be used to reject faulty rods and to adjust the operation of the machine. More specifically, circuit 327 feeds control signals to a servomotor 328 which changes the speed of the transmission 330. These adjustments alter the location at which the cut is made.

Koch also discusses one type of logic circuit which can serve as the above-discussed circuit 327. Koch's circuit includes a plurality of counters which count pulses received from the encoder of the cutting mechanism 320. The counters begin counting when the detector detects a transition from one segment to an adjacent segment as the rod passes the detector 326. The length of the segments (and the location of the cut) can be gauged from the counts stored by the counters.

The above-described technique may have a number of shortcomings. It may not always be possible to uniformly detect the transition between filter rod segments. For instance, the output of the detector 326 may have a certain amount of noise. Further, the filter rod itself can have a number of anomalies, such as small unintended air gaps between filter segments (referred to as "air rings"). Factors such as these can complicate the detection of the transition between adjacent segments, thus potentially producing inaccurate length measurements when the segment transitions are detected by simply passing a stream of data points through a threshold detector in the real-time manner described in the Koch patent.

Further, as described above, different cigarettes may use a different sequence of filter segments. Koch's logic circuit comprises a combination of discrete logic units which may not be suitable for inspecting different types of filter rods without significant re-engineering of the circuit design.

SUMMARY

It is accordingly one general objective of the present invention to provide an inspection system and method for examining the data received from a rod detector in a more "intelligent" and flexible manner than conventional systems.

This and other exemplary objectives are achieved according to the present invention using an inspection system comprising a plug combiner machine coupled to an Inspection Unit and a Human-Machine Interface Unit. The Inspection Unit maintains a sensor data array which stores data received from a sensor installed in the plug combiner machine. This data reflects the composition of the filter rods. The Inspection Unit also maintains a cut array which stores cut pulse data received from an encoder coupled to the knife installed in the plug combiner machine. This data reflects when the knife has severed the rods.

In operation, each knife pulse is created when the knife cuts a rod. This knife pulse serves as an interrupt signal. The interrupt signal causes the Inspection Unit to search the cut array for data associated with the rod which has just been cut. A frame of sensor data can be extracted from the sensor data array based on this data retrieved from the cut array (e.g., by mapping between the cut array and sensor data array). A frame corresponds to a portion of the sensor data array associated with the rod which has been cut.

Once the relevant frame has been found, the sensor signal contained therein is analyzed with respect to one or more thresholds to identify individual segments within the rod. The thresholds are dynamically adjusted on a periodic basis to account for various shifts in the sensor signal. Further, the frame of sensor data is analyzed such that any anomalies (such as air rings) do not interfere with the subsequent analysis. Rods containing air rings which are too large (with respect to user set points) are rejected.

The frame is then reviewed to determine whether the rod's segments are within tolerance. This is determined by comparing the results of analysis against a recipe which provides expected parameters for the rod. More specifically, the lengths of the individual segments, the order of the segments, the number of the segments and the cut registration location (which is defined as the distance between the middle of an air gap and a cut) are checked against the recipe.

Rods not meeting the recipe can be rejected. Further, the Inspection Unit can instruct the plug combiner machine to change the location at which the plug combiner machine makes its cut based on the results of its analysis (e.g., by adjusting the phase of the knife). Finally, the Inspection Unit stores statistics regarding the rods that it has inspected. These statistics are forwarded to the Human-Machine-Interface Unit at periodic intervals. At the Human-Machine-Interface Unit, the statistics are accumulated and displayed to an operator in various user-selectable display formats.

The present invention therefore extracts a frame of data from the sensor data array and performs various signal conditioning on the frame prior to any length measurements being made. This offers the potential of being more accurate than the above-discussed conventional technique using real-time transition triggers. Also, the present invention assesses out-of-tolerance rods by comparing a measured rod with respect to a pre-stored recipe. As such, raw data from the sensor can be interpreted differently depending on the recipe used. This offers the potential of being more flexible than the above-discussed technique which makes comparisons using a series of discrete logic devices.

BRIEF DESCRIPTION OF THE DRAWINGS

The foregoing, and other, objects, features and advantages of the present invention will be more readily understood upon reading the following detailed description in conjunction with the drawings in which.

DETAILED DESCRIPTION

Figure 1:
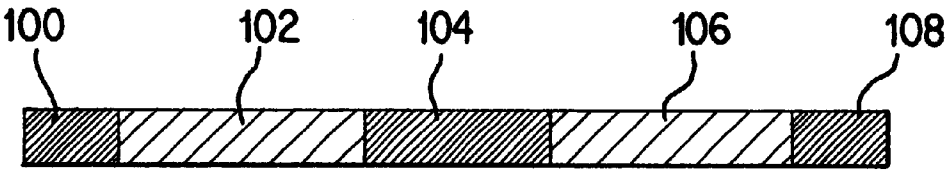
FIG. 1 (RELATED ART)
FIGS. 1 and 2 show the composition of two known types of filter rods.

In the following description, for purposes of explanation and not limitation, specific details are set forth in order to provide a thorough understanding of the invention. However it will be apparent to one skilled in the art that the present invention may be practiced in other embodiments that depart from these specific details. In other instances, detailed descriptions of well-known methods, devices, and circuits are omitted so as not to obscure the description of the present invention with unnecessary detail. In the drawings, like numerals represent like features.

A. Structural Features

Figure 4:
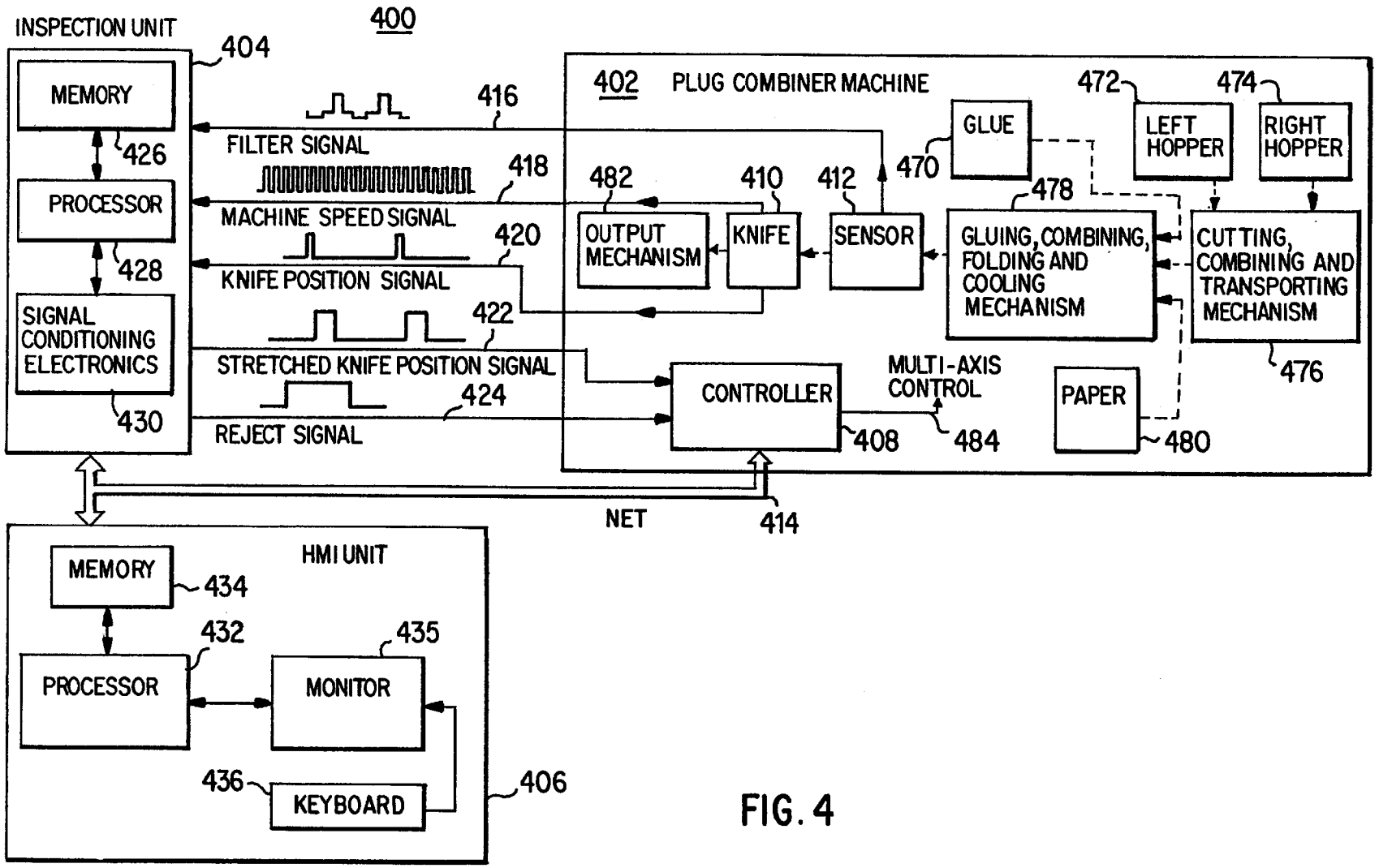
FIG. 4 shows an exemplary overview of the inspection system of the present invention.

FIG. 4 shows an overview of one exemplary system 400 for making filter rods according to the present invention. Three main units are shown: the plug combiner machine 402, the Inspection Unit 404 and the Human-to-Machine Interface Unit ("HMI Unit") 406.

The filter rods are produced in the plug combiner machine 402. A variety of different types of plug combiner machines 402 can be used, including the Hauni MULFI combiner (produced by Hauni-Werke Körber & Co. KG of Hamburg, Germany), the Molins DR25 (produced by Molins PLC, Milton Keynes, United Kingdom), the Molins DAPTC, etc. The above referenced patent to Koch also shows a combiner that can be used in conjunction with the present invention. Because of the variety of different techniques that can be used, the structures of certain features of the plug combiner machine 402 are illustrated and discussed in general terms.

As shown in FIG. 4, an exemplary combiner 402 includes a left hopper 472 and a right hopper 474. In one exemplary embodiment, the left hopper 472 stores white ("white") cellulose acetate (CA) 90 mm feed rods and the right hopper 474 stores 80 mm charcoal ("charcoal") impregnated cellulose acetate (CA) feed rods. The length and type of these rods are product-dependent.

Rods are removed from the hoppers 472 and 474 and are processed by mechanism 476. Mechanism 476 generally represents a series of devices for cutting the rods into smaller segments and combining these segments into a desired sequence. For instance, the 90 mm white acetate rods can be cut into six 15 mm segments and the 80 mm charcoal segments can be cut into four 20 mm rods. This, again, is exemplary. These segments can be transported to a combining device (such as a spacing drum, not shown), which combines a white, charcoal and white segment into a group and sets a 10 mm gap between each group.

The assembled groups are then transferred to mechanism 478. Mechanism 478 generally represents a series of devices for applying a tack line of glue (supplied from glue source 470) to paper (supplied from paper source 480), and then transferring the segment groups to the paper. The glue firmly holds and positions the segment groups with respect to the paper. Glue is not applied to the paper where the 10 mm gap is located. Unit 478 also includes known mechanisms for folding the paper with one edge up. A seam line of glue is then applied and a tube is formed to create a filter rod. The seam is set under a cooling bar.

Next, the filter rods are inspected by sensor 412. The sensor 412 may include any type of detector which can distinguish the properties of different filter rod segments. For example, a Hauni light barrier scanner can be used (produced by Hauni-Werke Körber & Co. KG of Hamburg, Germany). As the filter rod moves through the sensing area of this sensor 412, the sensor 412 outputs voltage changes depending on the material present in the filter rod. This may be accomplished using two opposing detector/emitter combinations (e.g., LED/photosensor combinations). The first and second emitters can be positioned such that their beams intersect at right angles. Those skilled in the art will recognize that other emitter/detector combinations can be used (e.g., additional emitter/detector pairs can be used, or only one emitter/detector pair can be used). When multiple detectors are used, their outputs can be averaged. The output of the sensor 412 can be transmitted on signal line 416, converted into a digital value and stored by the Inspection Unit 404 in a sensor data array.

After passing by the sensor 412, the filter rods are cut into smaller rods by the knife 410. In one exemplary embodiment, the knife 410 is a rotary cutting mechanism. The knife cuts a filter rod in each revolution. The knife is preferably servo-controlled to provide the desired degree of positioning accuracy.

The knife 410 has an encoder attached to it which serves as a position sensor. The knife encoder outputs two types of pulses. First, the encoder outputs a signal pulse each time the knife 410 severs a filter rod; this signal pulse is referred to as the knife position signal. The knife position signal can be an active high signal that is in phase with the knife. This signal is transmitted on signal line 420. Second, the knife encoder outputs a series of pulses per revolution of the knife, which, in turn, equates to a series of pulses per filter rod. These pulses are referred to as the machine speed signal. This signal can be transmitted on signal line 418. In one example, the encoder generates 1200 machine speed signal pulses per filter rod which corresponds to approximately 10 pulses per millimeter of rod travel. The knife position signals output from the knife encoder are stored by Inspection Unit 404 in a cut array.

In one example, the knife 410 is positioned approximately 4.25 inches downstream from the sensor 412, which corresponds in length to about one filter rod. Longer or shorter distances separating the knife 410 from the sensor 412 are possible.

After the filter rods are cut, they are passed to output mechanism 482. This mechanism can comprise a spiral kicker (not shown) which transfers the rods to a series of transfer drums (not shown). One of the transfer drums can be set up as a rejection port with the ability to reject single rods based on whether the Inspection Unit judges these rods as being out-of-tolerance. The rejection port is located downstream from the location where the filter rod was inspected (i.e., at the sensor 412). The plug combiner machine 402 takes this into account by tracking the rod through the plug combiner machine and activating the rejection port after an appropriate delay time. The delay time is selected such that the out-of-tolerance rod will be located at the rejection port when the rejection port is activated. Within-tolerance rods can be dropped to a conveyor belt (not shown) and can either be pneumatically transferred to a cigarette maker (not shown) or packed in a box for future use, for instance.

The plug combiner machine 402 also includes a controller 408 for coordinating the operation of the machine 402. For instance, according to a preferred embodiment, different units in the plug combiner machine 402 are driven by separate driving mechanisms (e.g., separate motors) which can be individually adjusted. In this sense, the plug combiner machine 402 is said to employ "multiple axes" control. The controller 408 ensures that these driving mechanisms are operating in synchronism with each other. This can be accomplished by selecting one of the units as a "master" unit, and then coordinating the operation of all other independent units with the master unit. It is preferable to select a unit having stable operation as the master unit. This is because the master unit serves as a reference, so that any error in its operation will be passed to the other units. In one exemplary embodiment, the mechanism which transports rods from the left hopper 472 can serve as the master unit. Therefore, in this embodiment, the timing of other units in the plug combiner machine 402 (such as the knife 410) is adjusted using the timing of the left hopper transfer mechanism. The present invention is also applicable to plug combiner machines which uses "single axis" control, in which the operation of all units in the machine are tied to a common transmission. In these machines, a fixed series of gears or other mechanical provisions may defined the interaction between different units in the plug combiner machine 402.

The controller 408 of plug combiner machine 402 is also coupled to the Inspection Unit 404 and the Human-Machine Interface Unit ("HMI Unit") 406.

The Inspection Unit 404 comprises a processor 428 coupled to a memory 426 and optional signal conditioning electronics 430, comprising, for example, one or more data acquisition boards. As the name suggests, the Inspection Unit's 404 main task is to analyze the outputs received from the sensor 412 and the knife encoder to determine whether the filter rods meet prescribed standards. The Inspection Unit 404 communicates with the controller 408 of plug combiner machine 402 via signal lines 422 and 424.

Signal line 424 provides a reject signal to the controller 408 of the plug combiner machine 402. This signal instructs the plug combiner machine 402 to reject a filter rod produced by the machine 402. Signal line 422 provides a "stretched" knife position signal to the controller 408. The controller 408 uses this knife position signal to track rods through the combiner machine. The pulse is "stretched" (e.g., extended in time duration) in order to provide a sufficient time duration for the controller 408 to detect the pulse transition. The stretched knife position signal can be phased with respect to the above-discussed standard knife signal on line 420 so that the stretched knife position signal transitions occurs while the reject signal on line 424 is active in order for the controller 408 to register the reject.

The HMI Unit 406 includes a processor 432 coupled to a memory 434, input device (e.g., keyboard) 436 and output device (e.g., display monitor 435). As the name suggests, this unit allows the user to interface with the system 400 (i.e., the Inspection Unit 404 and the controller 408) by inputting various inspection parameters and by accumulating, organizing and presenting the analysis results of the Inspection Unit 404. The HMI software includes two separate programs: one for the plug combiner 402 machine control and one for data acquisition from the Inspection Unit 404.

As described above, the Inspection Unit 404 communicates with the plug combiner machine 402 via discrete signal lines 416, 418, 420, 422 and 424. Additionally, communication is provided between the Inspection Unit 404, HMI Unit 406 and plug combiner machine 402 via local net 414. More specifically, the Inspection Unit 404 communicates with the HMI Unit 406 using "named data pipes." The Inspection Unit 404 acts as a "pipe server," providing information to the HMI Unit 406 upon request. The HMI Unit may be referred to as an HMI client. Those skilled in the art will appreciate that other communication protocols can be used.

The HMI Unit 406 transmits recipe and calibration data to the Inspection Unit 404. ("Recipe" information describes the expected configuration of the rods which are being produced and inspected by the plug combiner machine 402.) The Inspection Unit 404 responds by forwarding statistical and other inspection data to the HMI Unit 406. The statistical data reflects recent measurements made by the Inspection Unit 404. This transaction between the Inspection Unit 404 and the HMI Unit 406 occurs (nominally) once every second (in one exemplary embodiment).

The Inspection Unit 404 is designed to run in the absence of the data pipe using previously saved parameters. That is, the Inspection Unit 404 continually adds inspection data to the statistics until the HMI Unit 406 requests data. Consequently, the Inspection Unit 404 continues to function even while the HMI Unit 406 is not communicating with it.

The Inspection Unit 404 and HMI Unit 406 also communicate a number of parameters to the controller 408 of the plug combiner machine 402 via the net 414. For instance, the controller 408 may receive a software integer referred to as the cut offset parameter corresponding to the distance, in thousandths of millimeters, that the cut must be moved, as determined by the Inspection Unit 404, in order to maintain a proper cut registration. Cuts are adjusted by changing the phase of the knife with respect to other "axes" (independent motors) in the plug combiner machine.

B. Sensor Analysis Features

Overview

Figure 5:
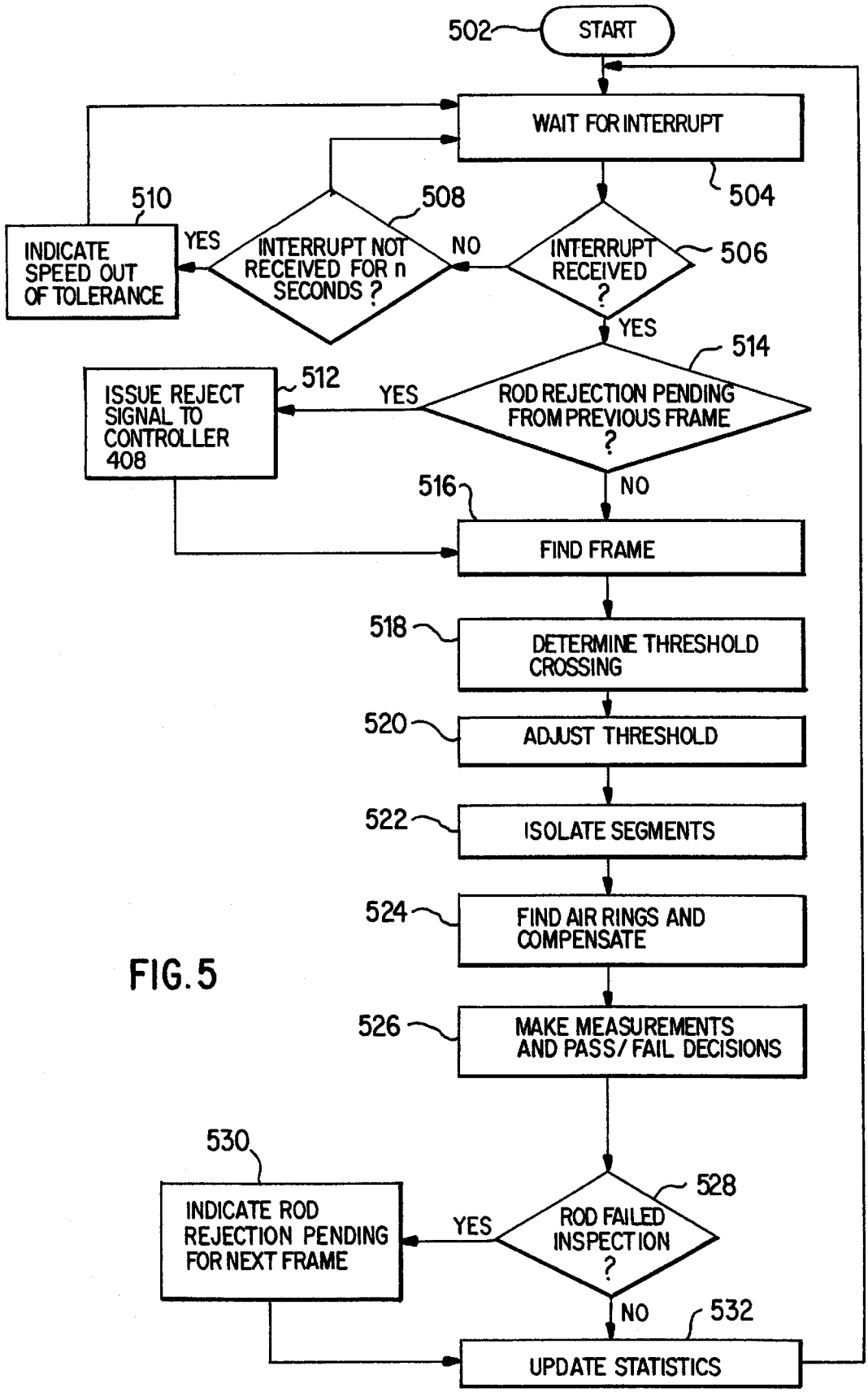
FIG. 5 shows a flowchart indicating the main steps in the inspection algorithm performed by the Inspection Unit of the present invention.

FIG. 5 provides an overview of the analysis performed by the Inspection Unit 404. The steps in FIG. 5 have been illustrated in a certain order to facilitate discussion. However, it should be apparent to those skilled in the art that the order of these steps can be changed, and some steps can proceed in parallel with other steps. Individual steps in FIG. 5 are discussed in greater detail in later sections.

After the start of the analysis (in step 502), the Inspection Unit 404 waits to receive an interrupt (in step 504). As previously described, interrupts are generated when a knife position signal (on line 420) is received, indicating that the knife 410 has just cut a rod. If an interrupt has not been received in a prescribed amount of time (as determined in steps 506 and 508), the Inspect Unit 404 indicates that the speed is out of tolerance (in step 510).

Providing that an interrupt signal has been received (as determined in step 506), the algorithm advances to step 514. This step determines whether a rod rejection has been logged during the analysis of a previous frame. (A frame is a collection of data from the sensor array which indicates the composition of one filter rod, and in this case, a previously analyzed filter rod.) If so, a reject signal is issued to the controller 408 (in step 512). If a rod rejection has not been logged during the analysis of a previous frame (indicating that the frame was, e.g., error free), the algorithm advances to step 516.

In step 516, the Inspection Unit 404 locates a new frame of information to inspect. The step of finding the frame comprises searching through the cut array to determine the data points which corresponds to the rod which has just been cut, and then mapping these points back to the sensor data array. This "mapping back" is a function of the distance between the sensor 412 and the knife 410.

Figure 6:
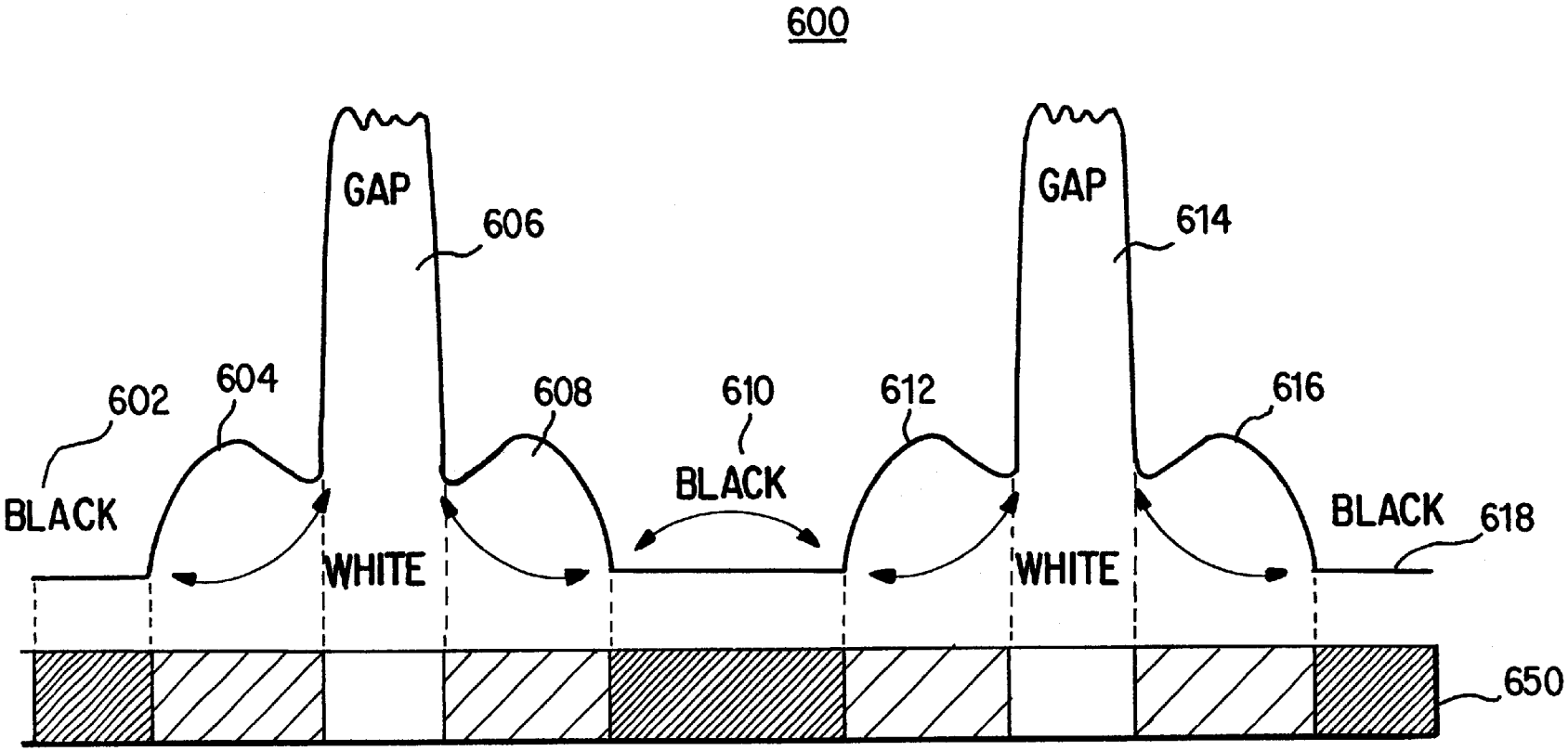
FIG. 6 shows an example of a frame of data produced by the sensor.

FIG. 6 provides an exemplary indication of the appearance of the sensor signal for a frame of data produced by a filter rod 650. The signal has "low" or "black" sections 602, 610 and 618 produced when the sensor 412 transmits light through the charcoal segments (i.e., charcoal impregnated CA segments). This is because these sections are the most opaque to light. The signal has "medium" or "white" portions 604, 608, 612 and 616 corresponding to the cellulose acetate sections. Finally, the signal has "high" or "gap" sections 606 and 614 corresponding to the gap segments of the filter rod. The gap sections are highest because they contain the least amount of material to interfere with the light as it passes through the filter rod. The different sections of the sensor signal are mapped to corresponding segments in the filter rod 650 to facilitate interpretation of the sensor signal.

There is no fixed correlation between "low" and "black" values, "medium" and "white" values, and "high" and "gap" values. The HMI Unit 406 interprets the low, medium and high values received by the Inspection Unit 404 differently depending on the recipe that is used. For instance, some cigarettes do not have charcoal segments. They just have white segments (e.g., cellulose acetate segments) and gaps. In this case, the low signal could be defined as the white segment.

Returning to FIG. 5, having located the frame of data corresponding to a filter rod, the Inspection Unit 404 commences its analysis on the frame of data itself. This procedure starts by determining (in step 518) when the sensor data crosses prescribed thresholds, indicating the location of transitions between adjacent rod segments. According to exemplary embodiments, two threshold levels can be used to ascertain the location of filter segment transitions. A low-to-medium threshold can be used to signal the transition from a charcoal segment to a cellulose acetate segment, while a medium-to-high threshold can be used to signal the transition from a cellulose acetate segment to a gap segment. In filter rods having only two different segment types, one of these thresholds will remain "idle." Filter rods having more than three different types of filter segments can be inspected by providing additional levels of thresholds, as will be apparent to those skilled in the art.

The levels used to calculate the thresholds are periodically updated (in step 520). By way of overview, this updating consists of noting the average level of signals attributed to different filter segments. The thresholds are changed to track changes in these averages. Thereafter, the segments are isolated in step 522, e.g., defined as black, gap and white regions (for one particular variety of cigarette).

Figure 2:
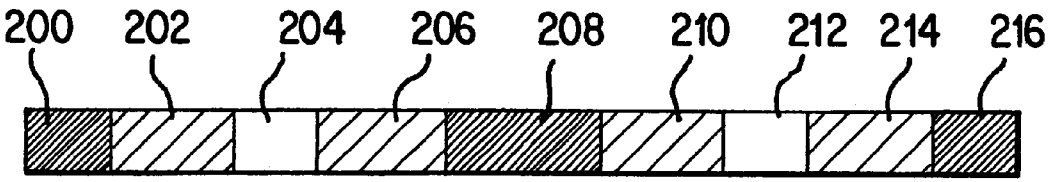
FIG. 2 (RELATED ART)
Figure 3:
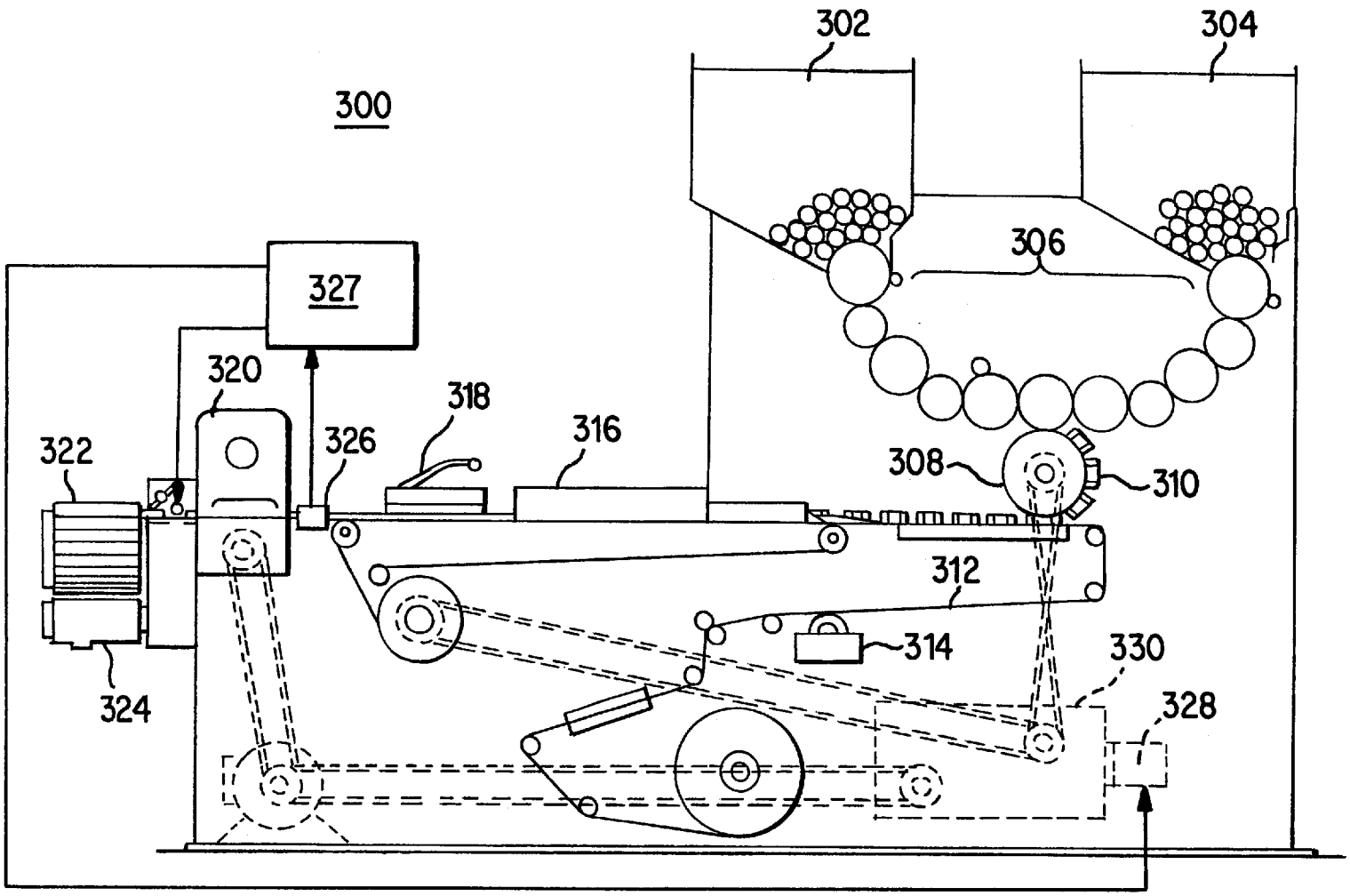
FIG. 3 (RELATED ART)
FIG. 3 shows one example of a known plug combiner machine.

Having decided which data points in the frame are associated with the different segments within the rod, the Inspection Unit 404 next "cleans up" the frame of sensor data to account for various anomalies that may be present in the signal (in step 524). For instance, an air ring is an unintended column of air between adjacent filter segments. In the example shown in FIG. 2, the plug combiner machine 300 might produce an air ring between adjacent charcoal and cellulose acetate segments. The Inspection Unit 514 determines the occurrence of these air rings, which resemble small gaps. This involves discriminating the air rings from the gaps. Filter rods with air rings which are larger than a standard of acceptability are rejected by the plug combiner machine 402, as instructed by the Inspection Unit 404.

The Inspection Unit then commences actually making measurements on the frame of data corresponding to one filter rod (in step 526). More specifically, the Inspection Unit 404 determines whether the filter segments have a prescribed number and order of segments, and whether the segments have prescribed lengths. Also, the Inspection Unit 404 determines whether the knife 410 made its cut in the correct location.

An assessment is made at this time (in step 528) whether the analysis indicates that a rod has failed inspection. If so, the frame under analysis is logged as corresponding to a rod which should be rejected (in step 530). This information is accessed when processing the next frame of information (in step 514) and a signal is sent to the controller 408 to instruct the plug combiner machine 402 to reject the rod which failed inspection.

Regardless of whether the filter rod has passed inspection, the Inspection Unit 404 accumulates its measurements in various statistical counters (in step 532). These measurements are forwarded to the HMI Unit 406 upon request from that unit.

After completing the analysis of a filter rod, the Inspection Unit 402 repeats its analysis on the next rod (by returning to step 504).

Selected steps in the above-described algorithm will now be discussed in greater detail.

Step 516: Locating a Frame of Sensor Data

Figure 7:
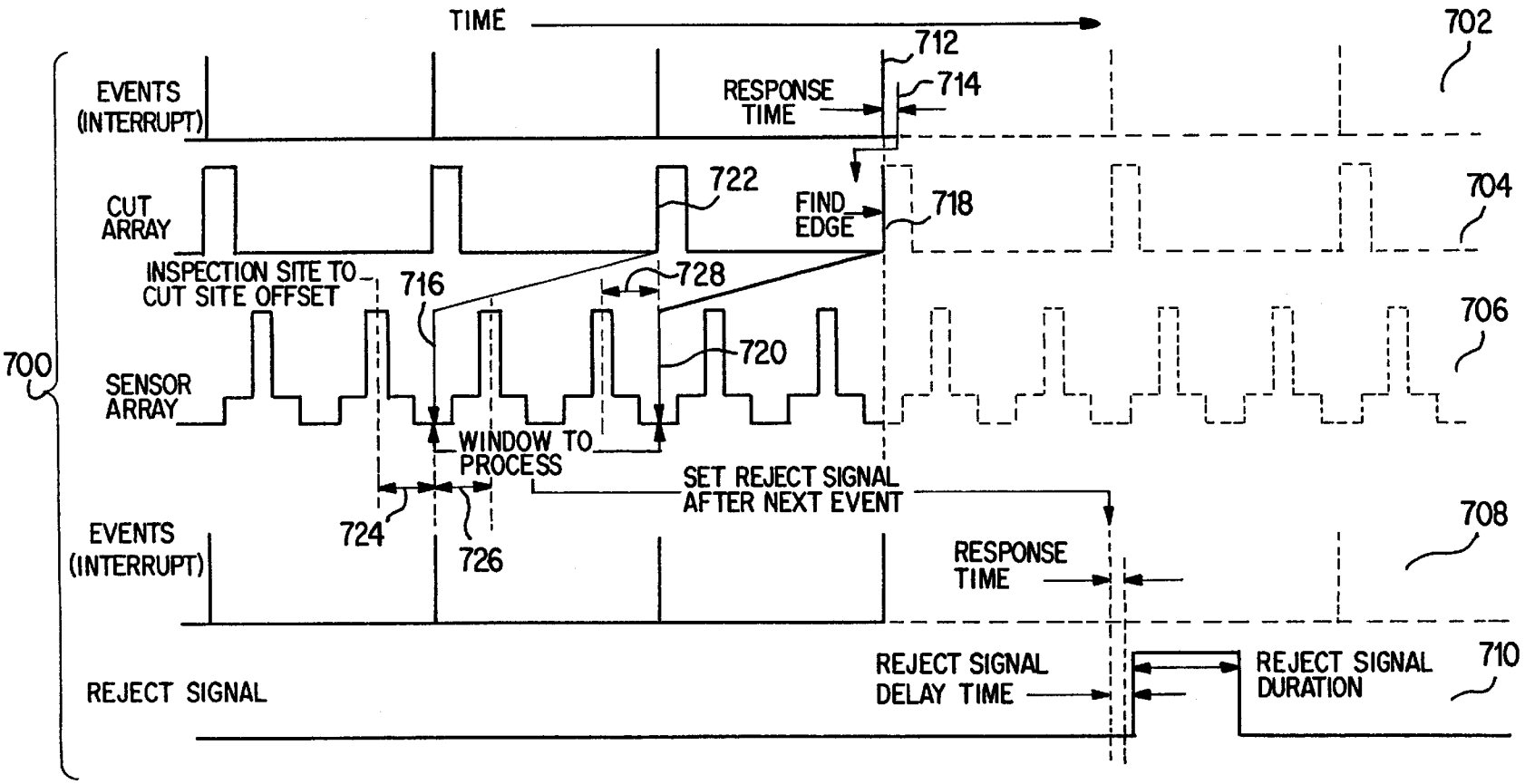
FIG. 7 shows a series of timing signals illustrative of the operation of the inspection system.
Figure 8A:
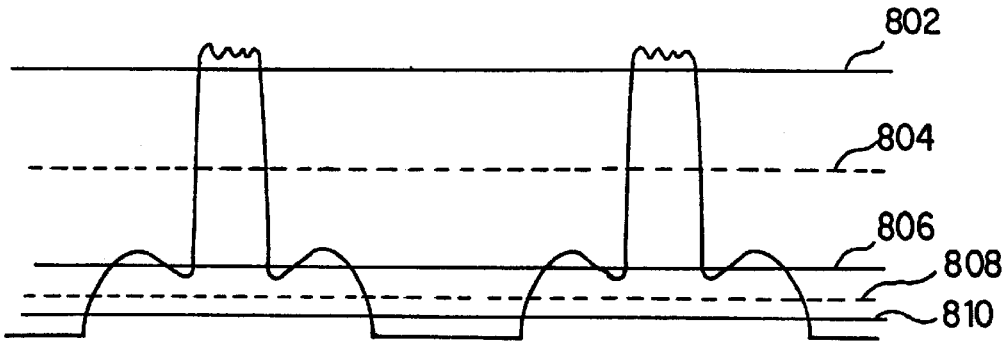
FIGS. 8(*a*), 8(*b*), 8(*c*) and 8(*d*) explain the use of thresholds for interpreting the sensor data.
Figure 8B:
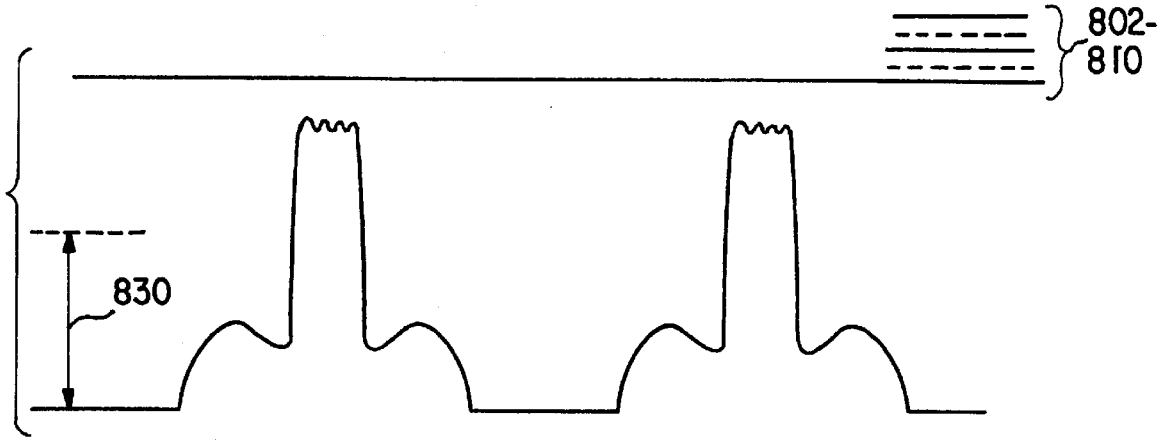
Figure 8C:
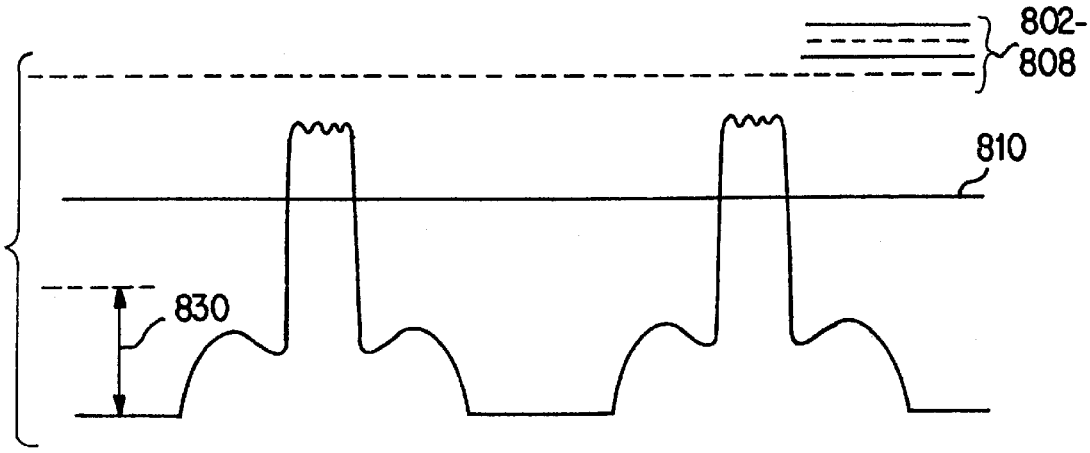
Figure 8D:
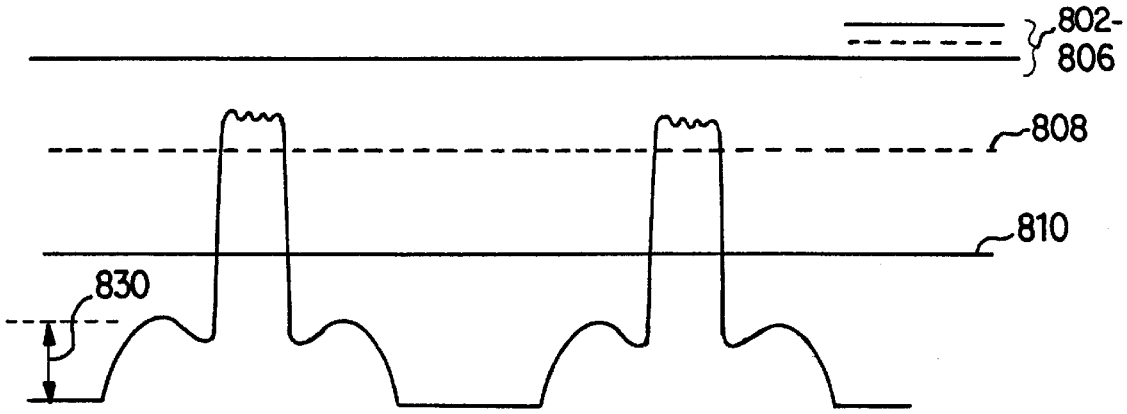

FIG. 7 provides a series of timing signals 700 to illustrate how the Inspection Unit 404 determines the location of a frame of data within the sensor array. First, a knife position signal pulse is received by the Inspection Unit 404 on line 420, which prompts the generation of an interrupt signal 702. This interrupt signal 702 commands the Inspection Unit 404 to locate the beginning and end of the frame corresponding to the rod that had just been severed. The beginning and end of the frame are denoted by lines 716 and 720, respectively, corresponding to two respective cuts.

In the normal course of operation, the Inspection Unit 404 will already know where the beginning of the frame lies in the sensor array. Notably, the beginning point 716 should correspond to the end point of the previously analyzed frame (e.g., the frame to the immediate left of the frame bracketed by lines 716 and 720).

Locating the end of the frame requires more work. First, the location in the cut array signal 704 corresponding to the end of the frame is determined, which corresponds to point 718. This point is found by reviewing the signals in the cut array signal 704 for the occurrence of the transition 718, marking an edge of the cut pulse. This edge does not necessarily correspond to the exact point in time that the interrupt signal pulse occurred, because there may be some time lag between the knife pulse and the generation of the interrupt, which is graphically represented in FIG. 7 by the separation in time between lines 712 and 714.

Once having found the edge of the cut pulse 718, the Inspection Unit 404 determines the ending point 720 of the frame by mapping the edge point 718 back in time a prescribed number of data points. This prescribed number of data points corresponds to the physical distance between the knife 410 and the sensor 412. That is, the distance between the knife 410 and the sensor 412 is associated with a fixed number of encoder machine speed pulses, which, in turn, corresponds to an equal number of data points in the sensor array signal 706. The end point 720 of the frame can be found by stepping back the prescribed number of data points from the location of the cut pulse 718.

Steps 518, 520 and 522: Thresholding and Isolating

Once the filter rod frame is mapped to the filter sensor data, the inspection algorithm determines the composition of the filter rod. To make this determination, the inspection algorithm first thresholds the sensor signals into low, medium and high signals, which, for one particular filter rod, correspond to black, white and gap segments, respectively. In a product such as illustrated in FIG. 1, the black and white classifications could be used to map the two different filter segments, with the gap region classification remaining idle (e.g., unused). The HMI Unit 406 communicates the recipe of the filter rod to the Inspection Unit 404, which provides the Inspection Unit 404 with an indication of the expected filter segment composition of the rod. Advantageously, the basic principles of the rod analysis do not differ for different types of filter rods.

FIG. 8(*a*) shows various levels used in the thresholding process to discriminate different segments in a filter rod. Dashed lines denote threshold levels, while solid lines denote average values. Namely, dashed line 808 denotes a low-to-medium threshold, and dashed line 804 denotes a medium-to-high threshold. Solid lines 810, 806 and 802 denote low, medium and high average values, respectively.

The threshold lines are used to indicate where one section ends and another begins. For instance, the location where the sensor signal crosses over the medium-to-high threshold 804 indicates the location where a gap starts. On the other hand, the low average value line 810 indicates the average value of all sensor data points which the algorithm is classifying as "low." The same applies to the medium and high average values lines (806, 802). These average levels are used, in part, to calculate the proper location of the threshold lines. Namely, the location of the medium-to-high threshold 804 is set such that it is a predetermined percentage (e.g., 50%) between the medium and high average lines (806, 802). The location of the low-to-medium threshold 808 is a predetermined percentage between the low and medium average lines (810, 806).

All of the threshold and average value lines are initially set as high values ("high" meaning very large values, not to be confused with the "high" state discussed above), as indicated in FIG. 8(*b*). This means that, upon system initialization or reset, all of the sensor signal falls below the low average line 810. Accordingly, all of the sensor signal will initially be categorized by the Inspection Unit 404 as low signal (e.g., corresponding to the charcoal segment). In actuality, the actual low average will lie somewhere around the level denoted by line 830.

In operation, the Inspection Unit 404 assesses the level of the actual average (e.g., level 830) after receiving a prescribed number of data points. The Inspection Unit 404 then compares the actual low average 830 to the prevailing low average 810. If the actual average 830 is different than the prevailing low average 810, then the prevailing average 810 will be adjusted to more closely reflect the actual average 830. For instance, if the prevailing average is 5 and the actual average is 2, then the prevailing average might be decreased by some level, e.g., by 1 or 2 levels. FIG. 8(*c*) shows how the low average 810 sinks down to more closely match the actual average 830.

The algorithm is configured such that the low average 810 cannot deviate from the low-to-medium threshold 808 by more than a prescribed number of levels. As initialization progresses, the low average 810 will eventually sink down to the point where it is separated from the low-to-medium threshold 808 by the prescribed number of levels. Any further decrease in the low average 810 will then be tracked by a corresponding decrease in the low-to-medium threshold 808. In other words, the low average 810 will eventually drag down the low-to-medium threshold 808. This is shown in FIG. 8(*d*), where the low-to-medium threshold 808 has moved down with the low average level 810. Also note in this figure that the actual low average 830 has decreased. This is because certain signals which were previously interpreted as low values are now being categorized as medium signals. This is a progressive by-product of the low-to-medium threshold 808 dropping down in the manner described.

Although not separately illustrated, the initialization process progresses by also eventually dragging the medium average 806, medium-to-high threshold 804 and the high average 802 down in a similar manner to that described above with respect to the low average 810 and the low-to-medium threshold 808. That is, the medium average 806 will begin to drop once the algorithm starts to classify parts of the sensor signal as medium signals. The dropping medium average level 806 will eventually drag the medium-to-high threshold 804 down with it. In the final stages, the high average 802 will eventually drop down. At this time, the levels should have settled in their steady-state condition shown in FIG. 8(*a*). Reliable segment classification can occur at this point.

Certain events during the operation of the system may cause significant deviations in the sensor levels. If this happens, the Inspection Unit 404 can reset all of the levels shown in FIG. 8(*a*) to their initial states shown in FIG. 8(*b*), and the thresholds can progressively settle in the manner discussed above. During normal operation, the average levels should vary only by small amounts. The threshold levels will track these changes because the threshold levels are set such that they are a predetermined percentage of the average level values which bracket them. That is, the low-to-medium threshold value 808 is a predetermined percentage of the low and medium average levels (810, 806), and the medium-to-high threshold value 804 is a predetermined percentage of the medium and high average levels (806, 802).

Once the thresholds have settled, the algorithm next advances to step 522 in which the segments are identified (or "isolated"). More specifically, based on the threshold levels determined in steps 518 and 520, regions within a frame are defined as black, white and gap regions (for one particular type of cigarette).

Step 524: Air Ring Detection and Compensation

Having properly determined the boundaries between adjacent filter segments, the next step is to eliminate various anomalies which may interfere with the analysis of the frame of data. An air ring is one such anomaly. As discussed above, in the filter rod shown in FIG. 2, an air ring comprises a typically small unintended column of air between the charcoal and cellulose acetate segments.

Figure 9:
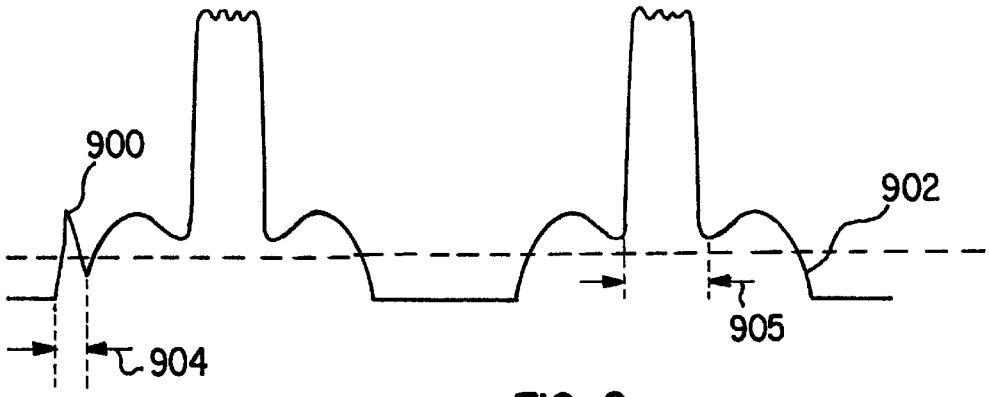
FIG. 9 shows an example of an air ring in the sensor signal.

FIG. 9 shows how an air ring 900 might appear in the sensor signal. One way of detecting the air ring is to search the sensor signal for regions containing a steep slope. This is because the air ring might manifest itself, as shown, by a spike having edges with steep slopes. However, the gap itself has a steep slope because, in effect, it is a large air ring. An air ring can be discriminated from a gap by excluding steeply sloped spikes having a wide base width 905 indicative of a gap. Air rings are characterized by spikes having a narrower base width 904.

Other air rings might not satisfy the above-described slope criterion. These air rings can be detected by examining the sensor signals for "rapid" fluctuations about the low-to-medium threshold 902 near the transition between white and black segments. For example, the air ring 900 shown in FIG. 9 starts off in the low level, changes to the medium level, moves back to the low level, and then moves back again to the medium level. The Inspection Unit 404 will flag such a low-medium-low-medium transition as a potential air ring.

Rods having large air rings can be rejected. Smaller air rings may be acceptable depending on the rejection thresholds set by the user.

Figure 10:
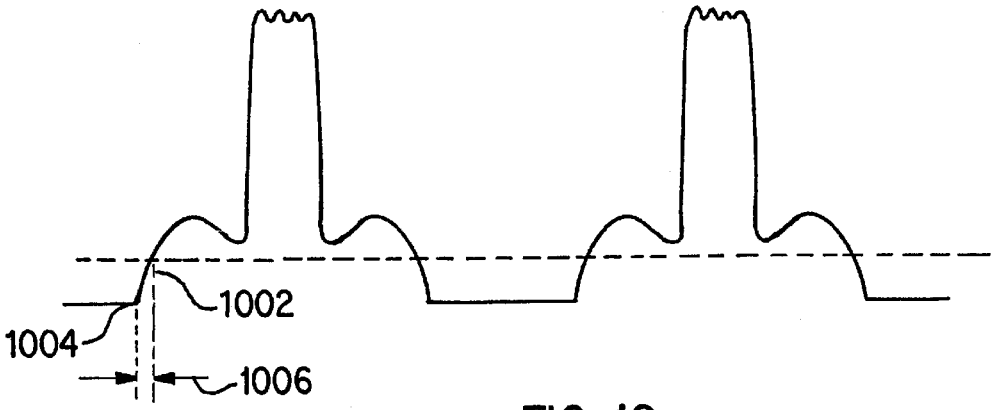
FIG. 10 shows an offsetting operation performed to correct the low-to-medium threshold crossing.

In step 524, the Inspection Unit 404 also compensates the threshold crossing points for potential inaccuracies. More specifically, the transition from white to gap segments (e.g., from a cellulose acetate segment to a gap segment) is typically abrupt and "clean." Hence, the medium-to-high threshold crossing registered by the Inspection Unit 404 likely corresponds to the actual boundary between these two segments. On the other hand, the transition from the black to white segments can be noisy, potentially producing an inaccurate indication of threshold crossing. For this reason, the low-to-medium threshold level is purposely set higher than the probable boundary location level, such that threshold crossing point will occur in a strong (e.g., less noisy) section of the sensor signal. The actual boundary between segments is then found by offsetting the detected low-to-medium threshold crossing by a predetermined amount, such as the amount 1006 shown in FIG. 10. After offsetting, the Inspection Unit 404 will register the point 1004 as the black-to-white segment boundary point, rather than the threshold crossing point 1002.

Steps 526, 528 and 532: Measurement and Analysis

Next, the inspection algorithm will determine if the plug meets the inspection criteria. This involves determining the lengths of the segments in the rod, order of the segments in the rod, and numbers of like segments in the rod, and then comparing these measurements against the recipe which provides expected values and tolerances for these parameters.

Cut registration measurements are also made in this step. Referring back to FIG. 7, the system determines the centers of the gaps which bracket the cut indicated by line 716.

Then, the distances between the gap centers and the cut 716 are determined. That is, the distance 724 between the left-most gap center and the cut 716 is computed, followed by the distance 726 between the right-most gap center and the cut 716. The difference between these two registration distances (724, 726) indicates whether the cut was made too early or too late. This difference is referred to as the registration offset distance. It should be noted that the distance 724 pertains to a previously analyzed rod, and thus can be advantageously stored when that earlier frame was processed, and recalled when the next frame is processed.

Plural registration offset distances are stored in a buffer. When a prescribed number of rods are sampled, the average offset distance is determined. The operation of the plug combiner machine 402 can then be adjusted to properly compensate for the measured net offset distance. Ideally, the net offset will be zero, requiring no adjustments.

In addition to compensating for the cut offset distance, the Inspection Unit 404 can also instruct the combiner machine 402 to reject out-of-tolerance rods. Rods can be rejected for a variety of reasons. For instance, rods can be rejected because their segments (including air gaps) are out of order, or the segments are too long or too short. Rods can be rejected because the machine is not running at full speed, or the thresholds have not settled. Further, rods can be rejected because of the presence of air rings or out-of-tolerance cut registration distances. Further, if the Inspection Unit 404 cannot successfully inspect a rod (e.g., a processing error has occurred), the rod is rejected. Other types of events can be detected simply by modifying the analysis performed by the HMI Unit 406 (e.g., by changing the recipe).

FIG. 7 shows the timing which governs the generation of the reject signal on line 424. As indicated there, the Inspection Unit 404 determines that the filter rod analyzed in the frame bounded by lines 716 and 720 should be rejected. During the next frame, the Inspection Unit 404 software will output a reject signal 710 to the plug combiner machine 402. Although the reject signal 710 is prompted by the interrupt signals 708, there will be some delay time separating an interrupt signal pulse and the reject signal pulse. The plug combiner machine will perform the plug tracking and rejection upon receipt of the reject signal 710.

In addition to controlling the phase of the knife, the statistics for each rod are added to cumulative statistical counters and the inspection algorithm goes into a wait state for the next trigger. Statistical inspection data are transmitted from the Inspection Unit 404 to the HMI Unit 406 for accumulation and display.

C. Human-Machine Interface Features

During each interval (nominally 1 second), the HMI Unit 406 provides inspection control information, calibration information, and recipe information to the Inspection Unit 404. More specifically, the HMI Unit 406 maintains recipe files that describe the rod in terms of component type (black, white, gap), component length, and cut registration length. Many different recipes can be stored in the recipe files and each rod recipe can have up to, by way of non-limiting example, 20 different components. This allows the inspection system to be easily converted from inspecting one type of rod to another type of rod.

Figure 11:
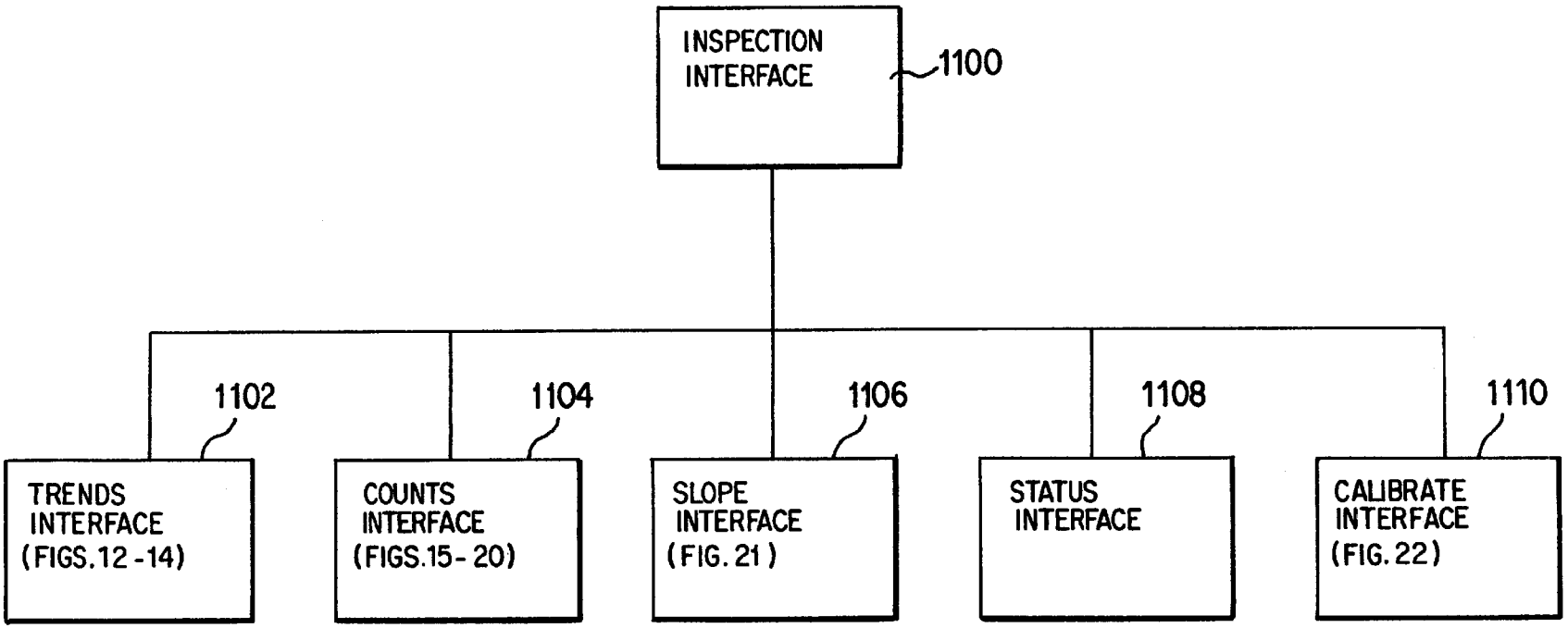
FIG. 11 shows an overview of the screens produced by the HMI Unit.

After receiving data from the Inspection Unit 404, the HMI Unit 406 software processes the statistical data for presentation to the user in several different formats. More specifically, the HMI Unit 406 contains a number of display modules to interface with the user, as summarized in FIG. 11, including a Trends interface format 1102, a Counts interface format 1104, a Scope interface format 1106, a Status interface format 1108 and a Calibrate interface format 1110. These displays collectively constitute the inspection interface 1100 of the inspection system 400.

Trend Screen Format

Figure 12:
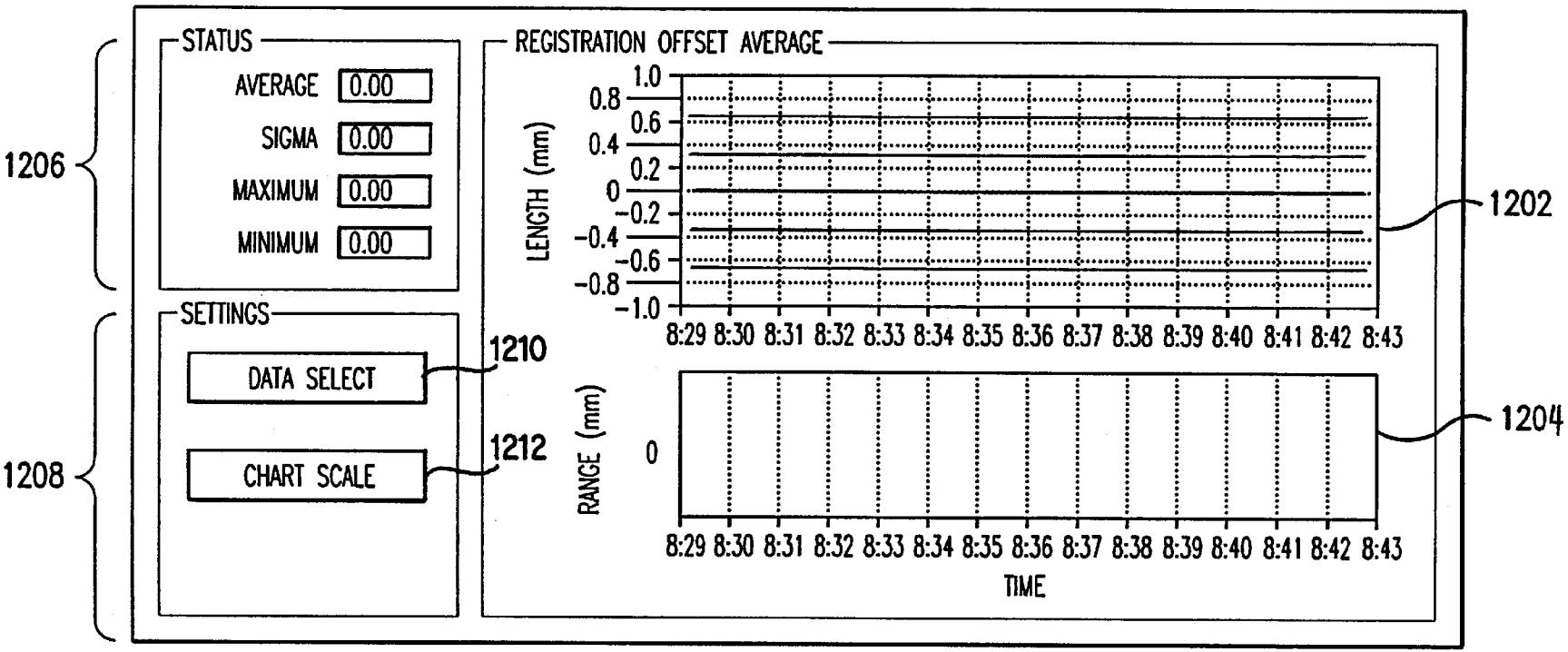
FIGS. 12–14 show different screens associated with the Trend screen format.
Figure 13:
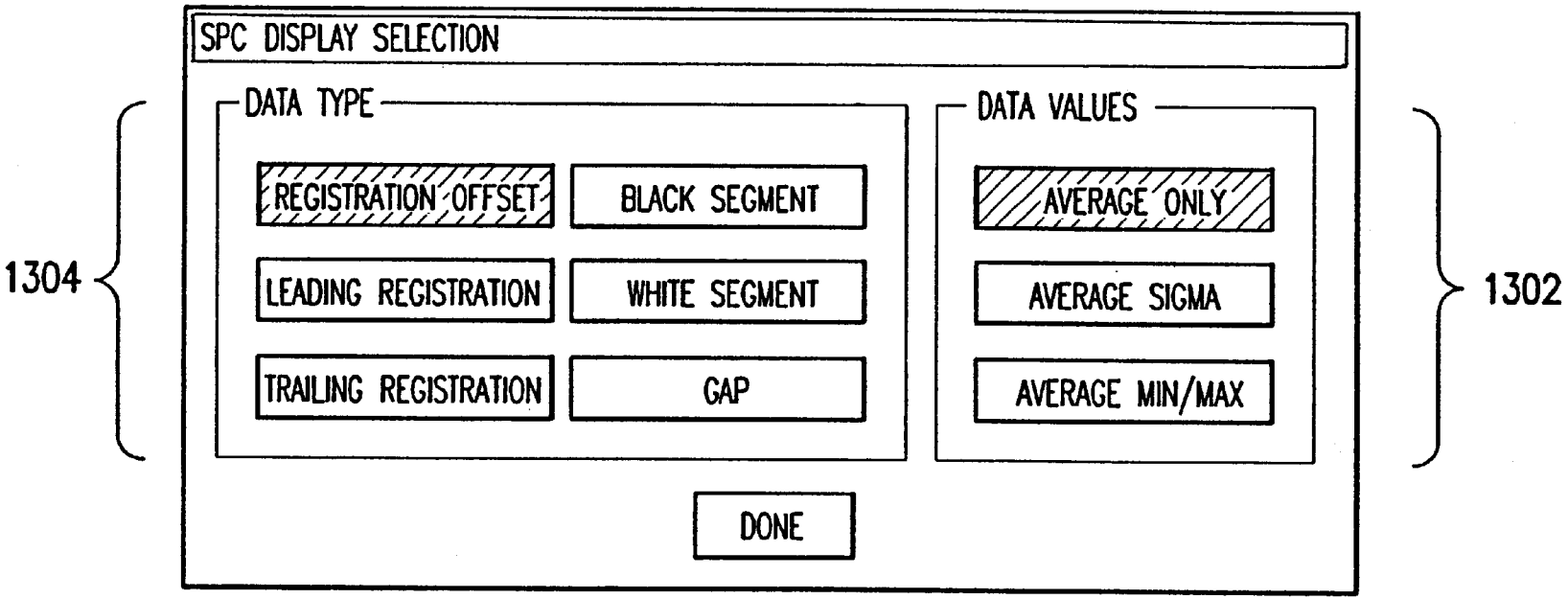
Figure 14:
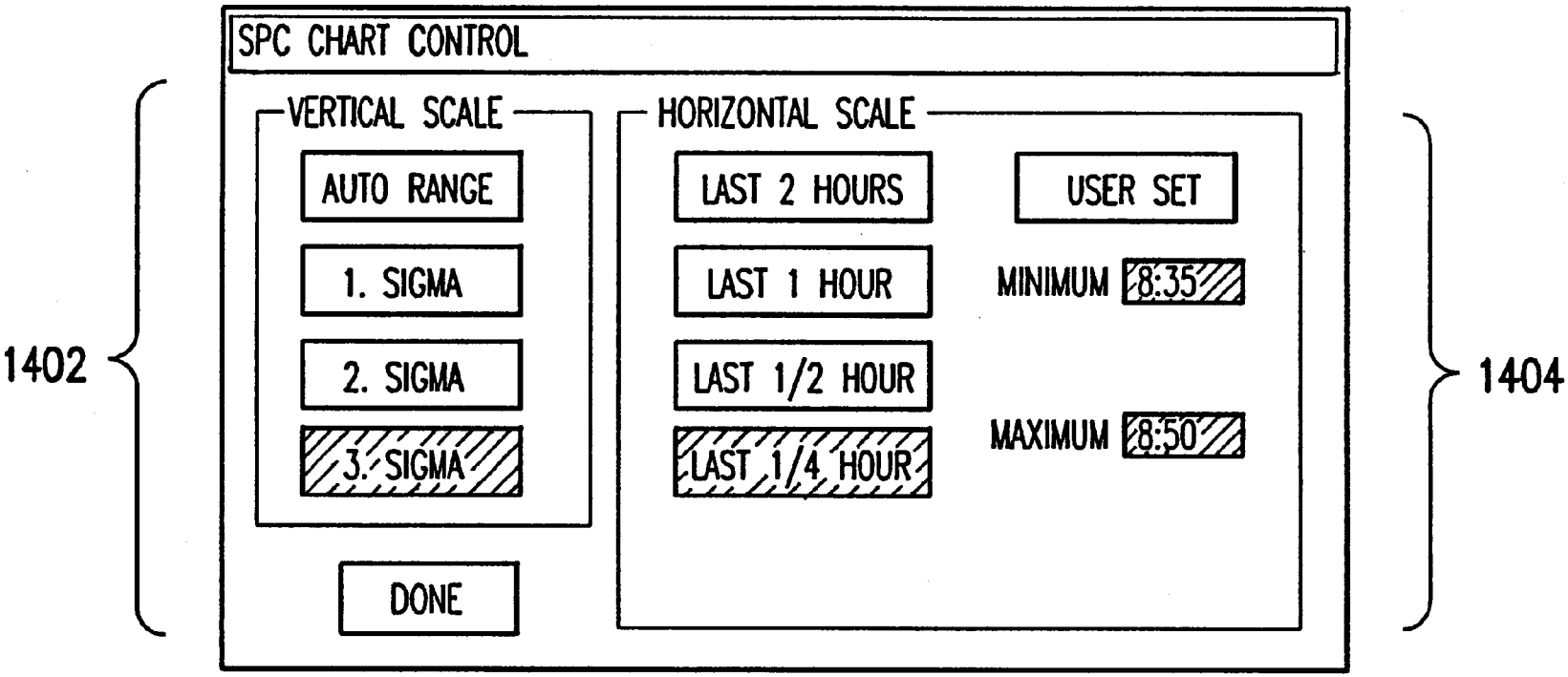

The trend screens are shown in FIGS. 12–14. With reference first to FIG. 12, the main trend screen includes upper chart 1202 which shows the time-averaged historical data accumulated by the inspection system 400. The bottom chart 1204 is a trend range chart which shows the range of the data for each data point in the trend average chart 1202. The range is calculated as the maximum data value minus the minimum data value for each data point.

The STATUS section 1206 displays 1 second statistics of the inspection data being received from the Inspection Unit 404, corresponding to the one second poll interval. More specifically, the STATUS section shows the following values for the data selected by the user: average value for the last 1 second; standard deviation of the values for the last 1 second; minimum value for the last 1 second; and maximum value for the last 1 second.

The SETTING section 1208 comprises a Data Select icon button 1210 and a Chart Scale button 1212. The Data Select button 1210 activates the display shown in FIG. 13. As indicated there, the user can select the type of data that is displayed on the trend charts in FIG. 12 by selecting one of the buttons in the Data Type section 1304 (e.g., Registration Offset, Leading Registration, Trailing Registration, Black Segment, White Segment and Gap). The Registration Offset corresponds to the distance that the knife must be moved to maintain a centered cut. The Leading Registration corresponds to the distance from the leading edge of the rod to the center of the leading gap. The Trailing Registration corresponds to the distance from the trailing edge of the rod to the center of the trailing gap. The Black Segment, White Segment and Gap Segment lengths correspond to the lengths of these respective sections.

The user can also select the type of data values that are displayed on the trend charts in FIG. 12 by selecting one of the buttons in the Data Values section 1302 (e.g., Average Only, Average/Sigma, Average/Min/Max. The Average Only option prompts the display of average data only. The Average/Sigma option prompts the display of average value, average plus the standard deviation of the values and the average minus the standard deviation of the values. The Average/Min/Max option prompts the display of the average value, the maximum of the values and the minimum of the values. The "Done" button closes the window shown in FIG. 13.

The Chart Scale button 1212 allows the user to select the scales of the trend window 1202. More specifically, pressing this button calls up the window shown in FIG. 14. This window allows the user to select the vertical scale and horizontal scale using sections 1402 and 1404, respectively. The vertical scale can be selected from the options of Auto-Range, 1 Sigma, 2 Sigma and 3 Sigma. The Auto -Range option adjusts the vertical scale to show all data. The 1, 2 and 3 Sigma buttons adjust the vertical scale to the first through third sigma ranges, respectively. The horizontal scale can also be selected between the Last 2 Hours, Last 1 Hour, Last ½ Hour, Last ¼ Hour and a user specified interval ("User Set"). Selection of these buttons will display data for the specified interval of time. The scale is adjusted as new data arrives (except for the User Set horizontal range).

Counts Screen Format

Counts are shown for the selected shift or re-settable counter. Only one counter is incremented at a time.

Figure 15:
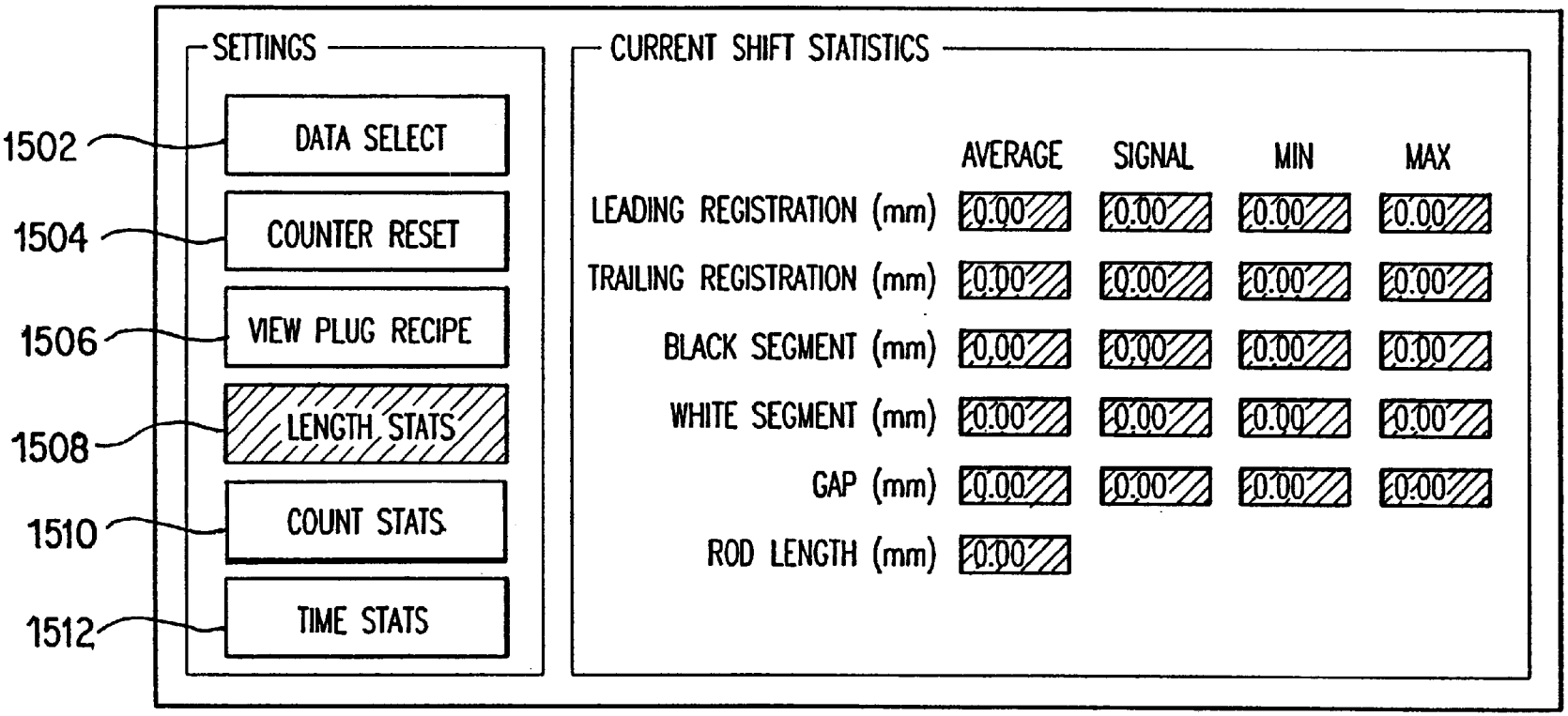
FIGS. 15–20 show different screens associated with the Counts screen format.
Figure 16:
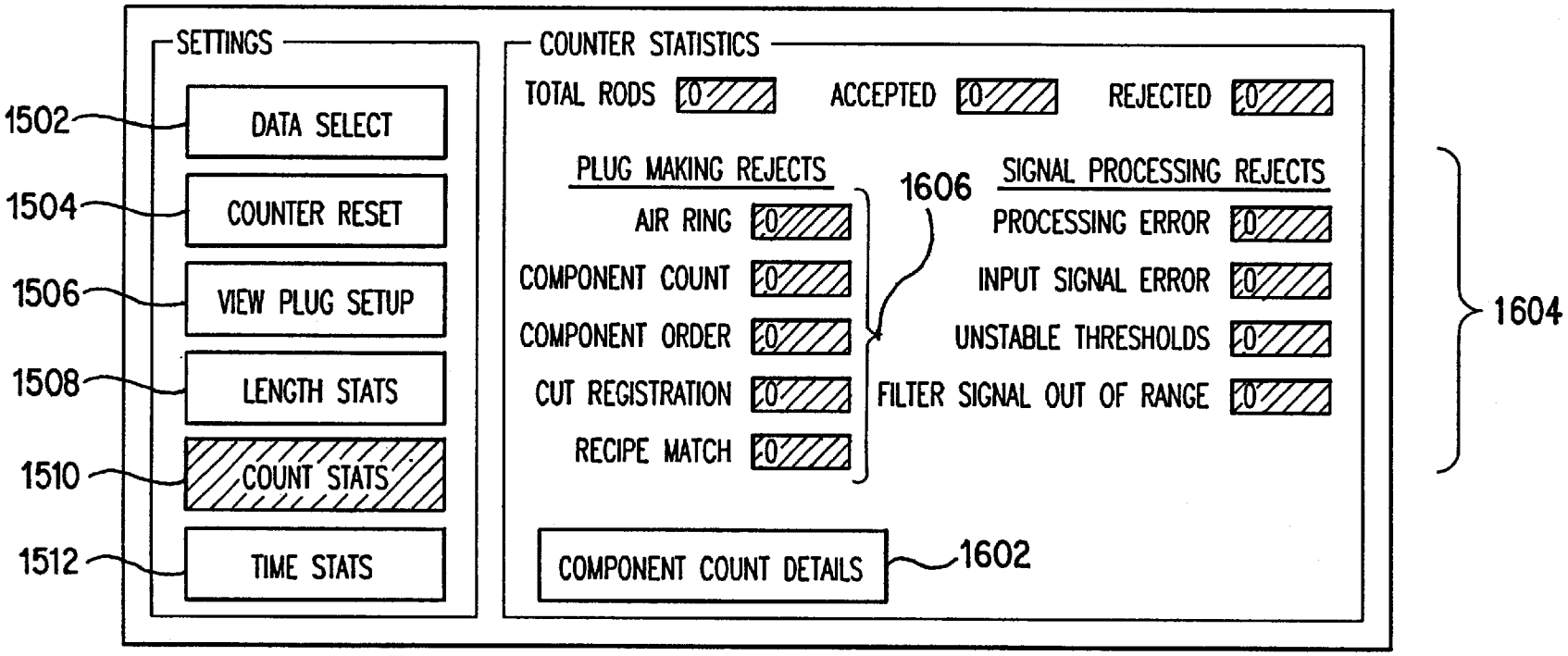
Figure 17:
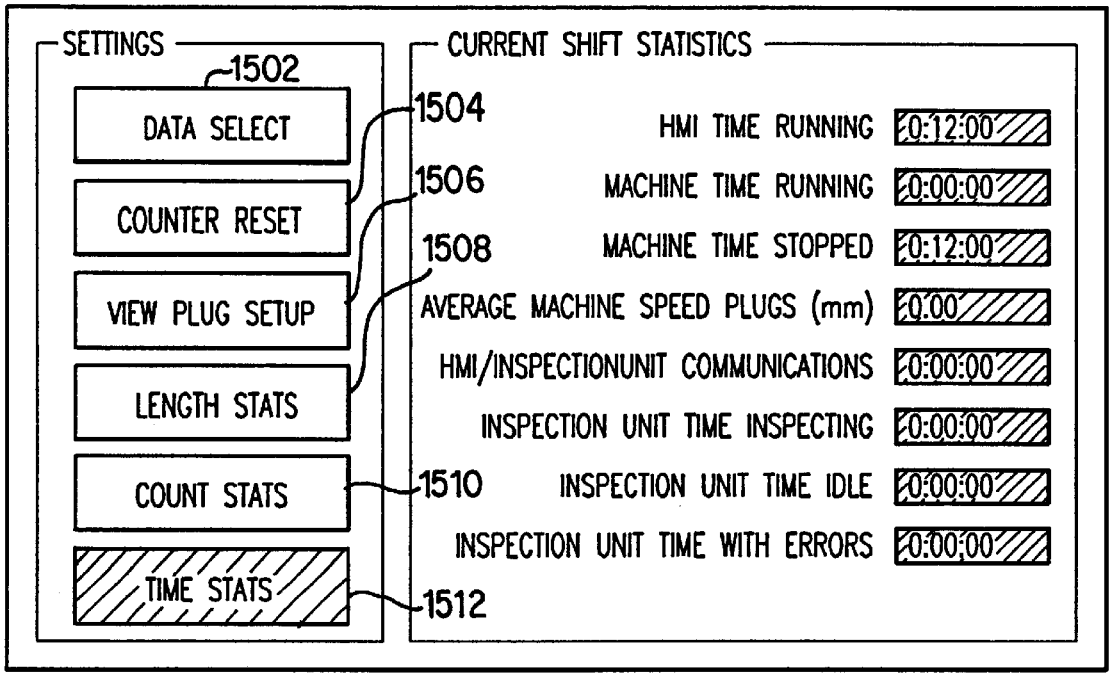

There are three different types of count screens, shown in FIGS. 15, 16 and 17, respectively. FIG. 15 is a count screen for showing length statistics for filter rod segments. This screen allows the user to display statistical data regarding the Leading Registration length, Trailing Registration length, Black Segment length, White Segment length, Gap length and overall Rod Length.

FIG. 16 shows another count screen for presenting counter statistics. This display provides an indication of the total rods inspected, total rods accepted, total rods rejected, and total waste counts. This display also provides an indication of various plug making rejects in section 1606. The parameter Air Rings counts the occurrences of rods with air rings. The Component Count counter is incremented when a filter rod does not contain the right number of black, white and gaps segment. Details of the component count can be observed by pressing the Component Count Details button 1602 (e.g., note FIG. 20). The Component Order count is incremented when the segments are out of order in a filter rod. The Cut Registration count is incremented when the cut registration is out of tolerance. The Recipe Match count is incremented when the length of one of the segments or gaps is out of tolerance.

The screen of FIG. 16 also presents a number of signal processing rejects in section 1604. This section generally provides an indication of rods rejected because the inspection system was not receiving all of the required signals from the combiner machine 402. There are additional reasons for processing errors which are not related to input signal errors. The Processing Error Count provides an indication of rods that are rejected because the inspection system encountered an internal error that prevented it from inspecting the rod. The Input Signal Error provides an indication of rods that were rejected because the inspection system was not receiving all of the signals to properly inspect the rod. The Unstable Thresholds count is incremented for rods that were rejected due to unstable signal thresholds. The Filter Signal Out of Range category is incremented for rods that were rejected because the amplitude of the filter signal was not large enough.

The screen of FIG. 17 provides time statistics. In this screen, the HMI Time Running parameter indicates the total time that the HMI Unit 406 has been running. The Machine Time Running presents the total time that the plug combiner machine 402 has been running. The Machine Stopped parameter indicates the total time that the plug combiner machine 402 was stopped. The Average Machine Speed parameter indicates the average machine speed. The HMI Unit/Inspection Unit Communications parameter indicates the total time that the HMI Unit 406 and the Inspection Unit 404 had valid communications. The Inspection Unit Time Inspecting presents the total time that the Inspection Unit 404 was in the inspection mode. The Inspection Unit Time Idle presents the total time that the Inspection Unit 404 was in an idle mode (due to, for instance, the machine not running). The Inspection Unit Time with Errors presents the total time the Inspection Unit 404 reported errors to the HMI Unit 406.

Figure 18:
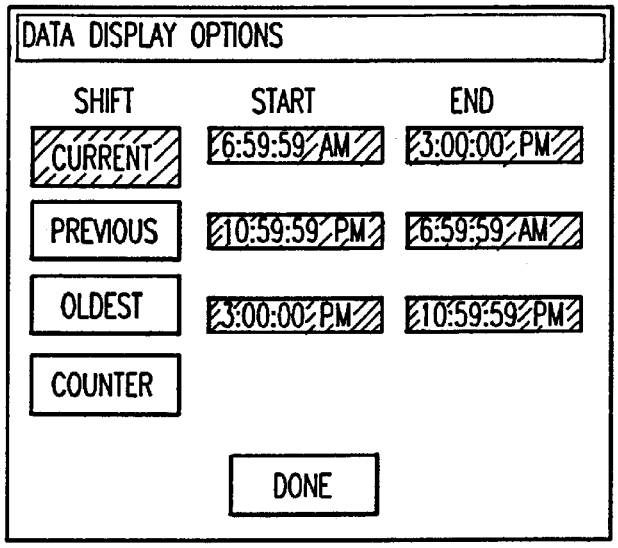

In addition to the three basic count screens shown in FIGS. 15, 16 and 17, the count screens have a number of associated displays generated by pressing the Data Select 1502 and View Plug Setup 1506 buttons (pressing the Counter Reset button 1504 resets the counters). The screen generated by pressing the Data Select button 1502 is shown in FIG. 18. This screen has a button for commanding the display of the current shift data on the counts screen, a button for commanding the display of previous shift data on the counts screen, a button for displaying the oldest shift data on the counts screen, and a button for displaying user-resettable counter data on the counts screen.

Figure 19:
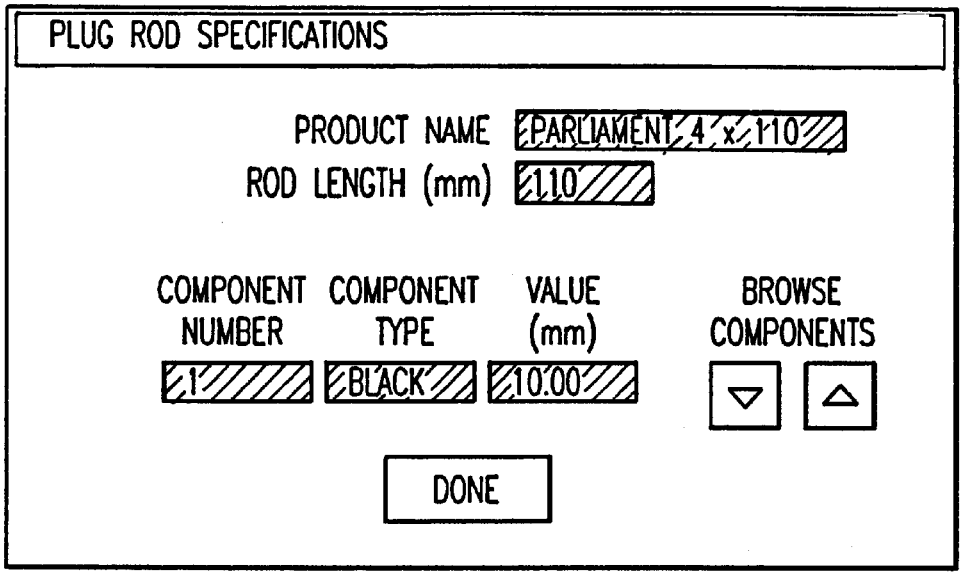

FIG. 19 shows the screen generated by pressing the View Plug Recipe button 1506. This display allows the user to view the Product Name, which is the recipe name being used by the inspection system, the Rod Length prescribed in the recipe, the current Component Number being viewed, the Component Type of the current component (e.g., black, white, gap) and the length of the component in millimeters. The browse UP command button displays the previous component in the recipe. The browse DOWN command button displays the next component in the recipe.

Figure 20:
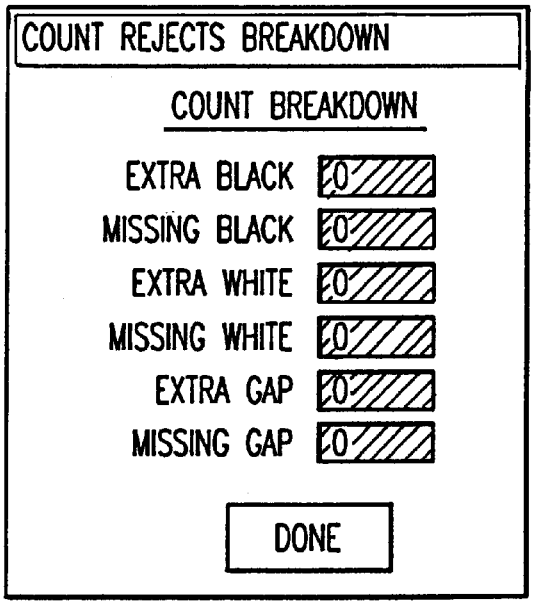

Finally, as mentioned, a count breakdown display shown in FIG. 20 can be accessed by pressing button 1602 (Component Count Detail) in the counter screen shown in FIG. 16. This display presents a breakdown of the types of anomalies which contributed to the component count shown in FIG. 16.

The Scope Screen and Status Screen Formats

Figure 21:
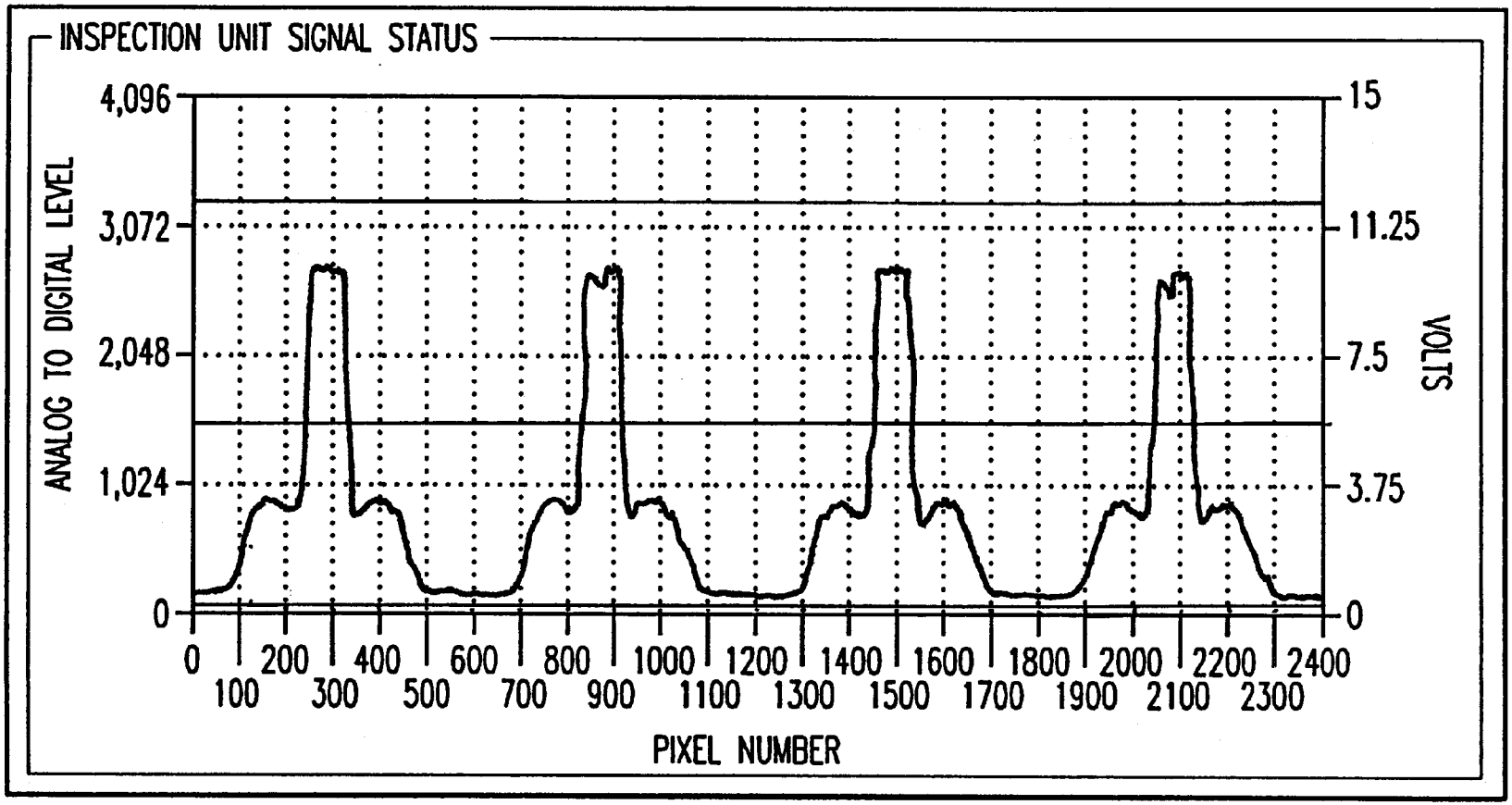
FIG. 21 shows a screen associated with the Scope screen format.

The scope screen is shown in FIG. 21. It can display a graphical representation of the sensor signal for two full plug rods. The status screen (not shown) provides a visual indication of the status of at least the HMI Unit 406 and the Inspection Unit 404.

Calibration Screen Format

Figure 22:
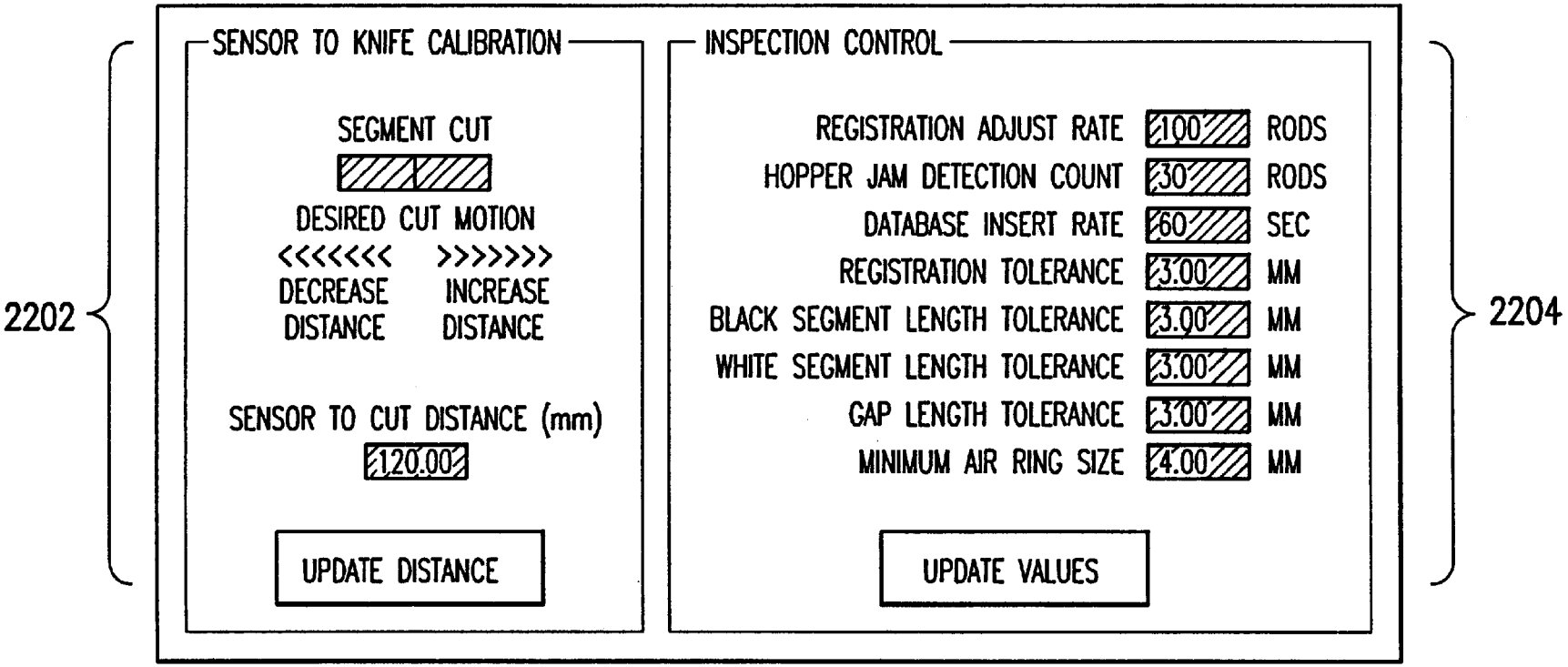
FIG. 22 shows a screen associated with the Calibrate screen format.

Finally, the calibration screen is shown in FIG. 22. This display contains two main sections: the Sensor to Knife Distance Calibration section 2202 and the Inspection Control section 2204. The Sensor to Knife Distance Calibration section 2202 allows the user to adjust the sensor location to knife location offset value being used by the Inspection Unit 404. Once the value is changed, the user should press the Update Distance button in order to activate the change. Generally, this value corresponds to the physical distance between the sensor 412 and the location where the rod is cut.

The section 2204 allows the user to enter additional calibration data. The Registration Adjust Rate denotes the number of filter rods sampled to determined the average offset distance. The Hopper Jam Detection Count denotes the number of plugs missing a given component type that must be inspected before a hopper jam error is declared by the Inspection Unit 404. The Database Insert Rate is the number of seconds that the HMI Unit 406 accumulates data from the Inspection Unit 404 before inserting the data into the database. The Database Insert Rate also dictates how frequently the points are displayed on the trend graphs. The Registration Tolerance denotes the tolerance (in mm) for the cut registration. Any filter rod with a registration outside of this tolerance will be rejected. The Black, White and Gap tolerances denote the tolerances (in mm) for the named segment measurements. Any rods with segments outside of the indicated tolerances will be rejected. The Minimum Air Ring Size denotes the smallest size for an air ring to cause the rod to be rejected. If a detected air ring has a width below this value, the rod will not be rejected.

It should be noted that the series of display screens identified above is entirely exemplary. The use of different plug combiner machines and different rod configurations may make a modified set of display screens more appropriate.

Still other variations of the above described principles will be apparent to those skilled in the art. All such variations and modifications are considered to be within the scope and spirit of the present invention as defined by the following claims.

What is claimed is:

1. A method for inspecting rods comprising plural segments, comprising the steps of:

inspecting a rod to determine the composition of the rod;

generating a first signal which reflects the composition of the rod based on the step of inspecting;

cutting the rod into sections;

generating a trigger signal in response to said step of cutting;

finding a frame of data from the first signal which corresponds to the rod which was cut in the cutting step; and performing inspection on the frame of data to determine whether the rod which was cut in the cutting step meets predetermined criteria.

2. The method of claim 1, wherein the step of finding a frame of data comprises locating a starting and ending point of the frame.

3. The method of claim 2, wherein the step of locating the starting point comprises retrieving an ending point of a previously stored frame within the first signal.

4. The method of claim 2, wherein the step of locating the ending point comprises identifying a pulse corresponding to the cut that was made in the step of cutting within a second signal, and then mapping the location of the pulse to the ending point of the frame within the first signal.

5. The method of claim 1, wherein said step of performing inspection comprises the step of determining when the data in said frame crosses at least one threshold to generate a potential filter segment boundary.

6. The method according to claim 5, further comprising the step of offsetting said potential filter segment boundary by a predetermined offset distance.

7. The method of claim 1, wherein said step of inspecting comprises identifying the occurrence of air rings within the frame of data.

8. The method of claim 1, wherein said step of inspecting comprises the steps of comparing measurements made on the frame of data with a pre-stored recipe indicating expected values for the measurements.

9. The method of claim 1, wherein said step of inspecting comprises the steps of determining at least one of:

the length of at least one segment in said rod;

the order of segments within said rod; and the number of segments within said rod.

10. The method of claim 1, wherein said step of inspecting comprises determining whether the cutting step produced a cut in the rod at a desired location by examining the frame of data.

11. The method of claim 1, further comprising the step of rejecting rods which do not meet the predetermined criteria.

12. The method of claim 10, further comprising the step of adjusting the location of a cutting device used in the cutting the rod if it is determined that the cut was made too early or late.

13. The method of claim 1, wherein the step of performing inspection comprises the step of determining whether a rod with a plurality of segments comprises segments of different opaque characteristics.

14. The method of claim 1, further comprising storing the first signal.

15. The method of claim 1, wherein the step of inspecting a rod, comprises inspecting a filter rod of a cigarette.

16. The method of claim 1, wherein the step of generating a first signal which reflects the composition of the rod comprises generating a first signal showing the composition of the rod to be one or more of a white cellulose acetate filter segment, a gap, and a charcoal impregnated cellulose acetate filter segment.

17. The method of claim 1, wherein the step of generating a first signal comprises generating a first signal comprising a continuous time varying signal, exhibiting a time varying amplitude characteristic.

18. The method of claim 17, wherein the step of generating a first signal comprising a first signal comprising a continues time varying signal, exhibiting a time varying amplitude characteristic defines the composition of the rod.

19. The method of claim 17, further comprising digitizing the first signal by a control circuit.

20. A system for producing and inspecting rods comprising plural segments, comprising:

a combiner machine for producing the rods having said plural segments, having:

a sensor for determining the composition of the rods, and for generating a first signal reflecting said composition; and a knife, located downstream from said sensor, for severing the rods, and for generating a second signal reflecting the occurrence of the severing; and an inspection unit coupled to the combiner machine for receiving said first and second signals, and further having:

logic for finding a frame of data within said first signal which corresponds to a rod which was cut by the knife; and logic for performing inspection on the frame of data to determine whether the filter rod which was cut by the knife meets predetermined criteria.

21. The system of claim 20, further comprising a human-to-machine interface unit for receiving inspection results produced by the logic for performing inspection and for setting tolerance to inspection criteria for said inspection unit.

22. The system of claim 20, wherein the plurality of segments comprises segments of different opaque characteristics.

23. The system of claim 20, further comprising logic for storing the first signal.

24. The system of claim 20, wherein the rod is a filter rod of a cigarette.

25. The system of claim 20, wherein the composition of the rod comprises one or more of a white cellulose acetate filter segment, a gap, and a charcoal impregnated cellulose acetate filter segment.

26. The system of claim 20, wherein the first signal comprises a continuous time varying signal, exhibiting a time varying amplitude characteristic.

27. The system of claim 26, wherein the time varying amplitude characteristic defines the composition of the rod.

28. The system of claim 26, wherein the first signal is digitized by a control circuit.

29. An inspection unit for use in conjunction with a combiner machine, the combiner machine producing rods having plural segments, the combiner machine having a sensor for determining the composition of the rods, and for generating a first signal reflecting said composition, and a knife, located downstream from the sensor, for severing the rods, and for generating a second signal reflecting the occurrence of the severing, the inspection unit comprising:

logic for receiving said first and second signals;

logic for finding a frame of data within the first signal which corresponds to a rod which was cut by the knife; and logic for performing inspection on the frame of data to determine whether the filter rod which was cut by the knife meets predetermined criteria.

30. The inspection unit of claim 29, wherein the plurality of segments comprises segments of different opaque characteristics.

31. The inspection unit of claim 29, further comprising logic for storing the first signal.

32. The system of claim 29, wherein the rod is a filter rod of a cigarette.

33. The system of claim 29, wherein the composition of the rod comprises one or more of a white cellulose acetate filter segment, a gap, and a charcoal impregnated cellulose acetate filter segment.

34. The system of claim 29, wherein the first signal comprises a continuous time varying signal, exhibiting a time varying amplitude characteristic.

35. The system of claim 34, wherein the time varying amplitude characteristic defines the composition of the rod.

36. The system of claim 34, wherein the first signal is digitized by a control circuit.

* * * * *